US011098475B2

(12) United States Patent
Collins et al.

(10) Patent No.: US 11,098,475 B2
(45) Date of Patent: Aug. 24, 2021

(54) BUILDING SYSTEM WITH A DIAPHRAGM PROVIDED BY PRE-FABRICATED FLOOR PANELS

(71) Applicant: Innovative Building Technologies, LLC, Seattle, WA (US)

(72) Inventors: Arlan Collins, Seattle, WA (US); Mark Woerman, Seattle, WA (US); Mark D'Amato, Seattle, WA (US)

(73) Assignee: Innovative Building Technologies, LLC, Seattle, WA (US)

( * ) Notice: Subject to any disclaimer, the term of this patent is extended or adjusted under 35 U.S.C. 154(b) by 16 days.

(21) Appl. No.: 15/975,309

(22) Filed: May 9, 2018

(65) Prior Publication Data

US 2018/0355601 A1 Dec. 13, 2018

Related U.S. Application Data

(60) Provisional application No. 62/505,692, filed on May 12, 2017.

(51) Int. Cl.
*E04B 1/24* (2006.01)
*E04B 5/10* (2006.01)
(Continued)

(52) U.S. Cl.
CPC ..... *E04B 1/2403* (2013.01); *E04B 1/24* (2013.01); *E04B 5/10* (2013.01); *E04B 2/7457* (2013.01);
(Continued)

(58) Field of Classification Search
CPC ..... E04B 1/34853; E04B 1/34861; E04B 1/3483; E04B 2001/2478;
(Continued)

(56) References Cited

U.S. PATENT DOCUMENTS 1,168,556 A 1/1916 Robinson et al.
1,501,288 A 7/1924 Morley
(Continued)

FOREIGN PATENT DOCUMENTS

AU 2005200682 5/2005
AU 2012211472 2/2014
(Continued)

OTHER PUBLICATIONS

US 8,701,371 B2, 04/2014, Collins et al. (withdrawn)
(Continued)

*Primary Examiner* — Christine T Cajilig

(57) ABSTRACT

A building system may include an external structural frame which includes a plurality of columns and beam, a diaphragm which includes a plurality of floor panels, each of the plurality of floor panels having a longitudinal direction and a transverse direction. The plurality of floor panels are supported by a plurality of diaphragm beams arranged along the transverse direction, and a coupling between each of the transverse beams and the external structural frame, wherein loads are transmitted from the diaphragm to the external structural frame only via the couplings between the transverse beams and the external structural frame.

23 Claims, 13 Drawing Sheets

(51) Int. Cl.
*E06B 3/46* (2006.01)
*E04B 2/74* (2006.01)

(52) U.S. Cl.
CPC ..... *E04B 2001/2418* (2013.01); *E04B 2001/2451* (2013.01); *E04B 2001/2481* (2013.01); *E04B 2001/2484* (2013.01); *E04B 2001/2496* (2013.01); *E04B 2103/06* (2013.01); *E06B 3/4609* (2013.01)

(58) Field of Classification Search
CPC .... E04B 2001/2484; E04B 5/10; E04B 5/023; E04B 5/026; E04B 5/046; E04C 2/521
See application file for complete search history.

(56) References Cited

U.S. PATENT DOCUMENTS 1,876,528 A 7/1931 Walters
1,883,376 A * 10/1932 Hilpert ..... E04B 1/24 52/654.1
2,160,161 A 5/1939 Marsh
2,419,319 A 4/1947 Lankton
2,495,862 A 1/1950 Osborn
2,562,050 A 7/1951 Lankton
2,686,420 A 8/1954 Youtz
2,722,724 A 11/1955 Miller
2,758,467 A 8/1956 Brown et al.
2,871,544 A 2/1959 Youtz
2,871,997 A 2/1959 Simpson et al.
2,877,990 A 3/1959 Goemann
2,946,413 A 7/1960 Weismann
3,017,723 A 1/1962 Von Heidenstam
3,052,449 A 9/1962 Long et al.
3,053,015 A 9/1962 George
3,053,509 A 9/1962 Haupt et al.
3,065,575 A 11/1962 Ray
3,079,652 A 3/1963 Wahlfeld
3,090,164 A 5/1963 Nels
3,184,893 A 5/1965 Booth
3,221,454 A 12/1965 Giulio
3,235,917 A 2/1966 Skubic
3,236,014 A 2/1966 Edgar
3,245,183 A 4/1966 Tessin
3,281,172 A 10/1966 Kuehl
3,315,424 A 4/1967 Smith
3,324,615 A 6/1967 Zinn
3,324,617 A 6/1967 Knight et al.
3,355,853 A 12/1967 Wallace
3,376,919 A 4/1968 Agostino
3,388,512 A 6/1968 Newman
3,392,497 A 7/1968 Vantine
3,411,252 A 11/1968 Boyle, Jr.
3,460,302 A 8/1969 Cooper
3,469,873 A 9/1969 Glaros
3,490,191 A 1/1970 Ekblom
3,533,205 A 10/1970 Pestel et al.
3,568,380 A 3/1971 Stucky et al.
3,579,935 A 5/1971 Regan et al.
3,590,393 A 7/1971 Hollander
3,594,965 A 7/1971 Saether
3,601,937 A 8/1971 Campbell
3,604,174 A 9/1971 Nelson, Jr.
3,608,258 A 9/1971 Spratt
3,614,803 A 10/1971 Matthews
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr
3,742,666 A 7/1973 Antoniou
3,750,366 A 8/1973 Rich, Jr. et al.
3,751,864 A 8/1973 Berger et al.
3,755,974 A 9/1973 Berman
3,762,115 A 10/1973 McCaul, III
3,766,574 A 10/1973 Smid, Jr.
3,821,818 A 7/1974 Alosi
3,823,520 A 7/1974 Ohta et al.
3,845,601 A 11/1974 Kostecky
3,853,452 A 12/1974 Delmonte
3,885,367 A 5/1975 Thunberg
3,906,686 A 9/1975 Dillon
3,921,362 A 11/1975 Ortega
3,926,486 A 12/1975 Sasnett
3,971,605 A 7/1976 Sasnett
3,974,618 A 8/1976 Cortina
3,990,202 A 11/1976 Becker
4,018,020 A 4/1977 Sauer et al.
4,038,796 A 8/1977 Eckel
4,050,215 A 9/1977 Fisher
4,059,936 A 11/1977 Lukens
4,065,905 A 1/1978 Lely et al.
4,078,345 A 3/1978 Piazzalunga
4,107,886 A 8/1978 Ray
4,112,173 A 9/1978 Roudebush
4,114,335 A 9/1978 Carroll
4,142,255 A 3/1979 Togni
4,161,087 A 7/1979 Levesque
4,170,858 A 10/1979 Walker
4,171,545 A 10/1979 Kann
4,176,504 A 12/1979 Huggins
4,178,343 A 12/1979 Rojo, Jr.
4,205,719 A 6/1980 Norell et al.
4,206,162 A 6/1980 Vanderklaauw
4,214,413 A 7/1980 Gonzalez Espinosa de Los
4,221,441 A 9/1980 Bain
4,226,061 A 10/1980 Day, Jr.
4,227,360 A 10/1980 Balinski
4,248,020 A 2/1981 Zielinski et al.
4,251,974 A 2/1981 Vanderklaauw
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,361,994 A 12/1982 Carver
4,389,831 A 6/1983 Baumann
4,397,127 A 8/1983 Mieyal
4,435,927 A 3/1984 Umezu
4,441,286 A 4/1984 Skvaril
4,447,987 A 5/1984 Lesosky
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,531,336 A 7/1985 Gartner
4,592,175 A 6/1986 Werner
4,646,495 A 3/1987 Chalik
4,648,228 A 3/1987 Kiselewski
4,655,011 A 4/1987 Borges
4,688,750 A 8/1987 Teague et al.
4,712,352 A 12/1987 Low
4,757,663 A 7/1988 Kuhr
4,813,193 A 3/1989 Altizer
4,856,244 A 8/1989 Clapp
4,862,663 A 9/1989 Krieger
4,893,435 A 1/1990 Shalit
4,910,932 A 3/1990 Honigman
4,918,897 A 4/1990 Luedtke
4,919,164 A 4/1990 Barenburg
4,974,366 A 12/1990 Tizzoni
4,991,368 A 2/1991 Amstutz
5,009,043 A 4/1991 Kurrasch
5,010,690 A 4/1991 Geoffrey
5,036,638 A 8/1991 Kurtz, Jr.
5,076,310 A 12/1991 Barenburg
5,079,890 A 1/1992 Kubik et al.
5,127,203 A 7/1992 Paquette
5,127,760 A 7/1992 Brady
5,154,029 A 10/1992 Sturgeon
5,185,971 A 2/1993 Johnson, Jr.
5,205,091 A 4/1993 Brown
5,212,921 A 5/1993 Unruh

(56) References Cited

U.S. PATENT DOCUMENTS 5,228,254 A 7/1993 Honeycutt, Jr.
5,233,810 A 8/1993 Jennings
5,254,203 A 10/1993 Corston
5,307,600 A 5/1994 Simon, Jr.
5,359,816 A 11/1994 Iacouides
5,359,820 A 11/1994 McKay
5,361,556 A 11/1994 Menchetti
5,402,612 A * 4/1995 diGirolamo ..... E04B 1/24 52/241
5,412,913 A 5/1995 Daniels et al.
5,426,894 A 6/1995 Headrick
5,452,552 A 9/1995 Ting
5,459,966 A 10/1995 Suarez
5,471,804 A 12/1995 Winter, IV
5,483,773 A 1/1996 Parisien
5,493,838 A 2/1996 Ross
5,509,242 A 4/1996 Rechsteiner et al.
5,519,971 A 5/1996 Ramirez
5,528,877 A 6/1996 Franklin
5,531,539 A 7/1996 Crawford
5,584,142 A 12/1996 Spiess
5,592,796 A 1/1997 Landers
5,593,115 A 1/1997 Lewis
5,611,173 A 3/1997 Headrick et al.
5,628,158 A 5/1997 Porter
5,640,824 A 6/1997 Johnson
5,660,017 A * 8/1997 Houghton ..... E04B 1/2403 52/167.3
5,678,384 A 10/1997 Maze
5,697,189 A 12/1997 Miller
5,699,643 A 12/1997 Kinard
5,706,607 A 1/1998 Frey
5,724,773 A 3/1998 Hall
5,735,100 A 4/1998 Campbell
5,743,330 A 4/1998 Bilotta et al.
5,746,034 A 5/1998 Luchetti et al.
5,755,982 A 5/1998 Strickland
5,850,686 A 12/1998 Mertes
5,867,964 A 2/1999 Perrin
5,870,867 A 2/1999 Mitchell
5,921,041 A 7/1999 Egri, II
5,970,680 A 10/1999 Powers
5,987,841 A 11/1999 Campo
5,992,109 A 11/1999 Jonker
5,997,792 A 12/1999 Gordon
6,000,194 A 12/1999 Nakamura
6,055,787 A 5/2000 Gerhaher et al.
6,073,401 A 6/2000 Iri et al.
6,073,413 A 6/2000 Tongiatama
6,076,319 A 6/2000 Hendershot
6,086,350 A 7/2000 Del Monte
6,128,877 A 10/2000 Goodman et al.
6,151,851 A 11/2000 Carter
6,154,774 A 11/2000 Furlong
6,170,214 B1 1/2001 Treister et al.
6,199,336 B1 3/2001 Poliquin
6,240,704 B1 6/2001 Porter
6,243,993 B1 6/2001 Swensson
6,244,002 B1 6/2001 Martin
6,244,008 B1 6/2001 Miller
6,260,329 B1 7/2001 Mills
6,289,646 B1 9/2001 Watanabe
6,301,838 B1 10/2001 Hall
6,308,465 B1 10/2001 Galloway et al.
6,308,491 B1 10/2001 Porter
6,340,508 B1 1/2002 Frommelt
6,371,188 B1 4/2002 Baczuk
6,393,774 B1 5/2002 Fisher
6,421,968 B2 7/2002 Degelsegger
6,427,407 B1 8/2002 Wilson
6,430,883 B1 8/2002 Paz et al.
6,446,396 B1 9/2002 Marangoni et al.
6,481,172 B1 11/2002 Porter
6,484,460 B2 11/2002 VanHaitsma
6,571,523 B2 6/2003 Chambers
6,625,937 B1 9/2003 Parker
6,651,393 B2 11/2003 Don
6,688,056 B2 2/2004 Von Hoyningen Huene et al.
6,729,094 B1 5/2004 Spencer et al.
6,748,709 B1 6/2004 Sherman et al.
6,807,790 B2 10/2004 Strickland et al.
6,837,013 B2 1/2005 Foderberg et al.
6,922,960 B2 8/2005 Sataka
6,935,079 B1 8/2005 Julian et al.
6,964,410 B1 11/2005 Hansen
7,007,343 B2 3/2006 Weiland
7,059,017 B1 6/2006 Rosko
7,143,555 B2 12/2006 Miller
RE39,462 E 1/2007 Brady
7,389,620 B1 6/2008 McManus
7,395,999 B2 7/2008 Walpole
7,444,793 B2 11/2008 Raftery et al.
7,467,469 B2 12/2008 Wall
7,484,329 B2 2/2009 Fiehler
7,484,339 B2 2/2009 Fiehler
7,493,729 B1 2/2009 Semmes
7,546,715 B2 6/2009 Roen
7,574,837 B2 8/2009 Hagen, Jr. et al.
7,640,702 B2 1/2010 Termohlen
7,658,045 B2 2/2010 Elliott et al.
7,676,998 B2 3/2010 Lessard
7,694,462 B2 4/2010 O'Callaghan
7,721,491 B2 5/2010 Appel
7,748,193 B2 7/2010 Knigge et al.
7,908,810 B2 3/2011 Payne, Jr. et al.
7,921,965 B1 4/2011 Surace
7,941,985 B2 5/2011 Simmons
7,966,778 B2 6/2011 Klein
8,051,623 B2 11/2011 Loyd
D652,956 S 1/2012 Tanaka et al.
8,096,084 B2 1/2012 Studebaker et al.
8,109,058 B2 2/2012 Miller
8,127,507 B1 3/2012 Bilge
8,166,716 B2 5/2012 Macdonald et al.
8,234,827 B1 8/2012 Schroeder, Sr.
8,234,833 B2 8/2012 Miller
8,251,175 B1 8/2012 Englert et al.
8,276,328 B2 10/2012 Pépin
8,322,086 B2 12/2012 Weber
8,359,808 B2 1/2013 Stephens, Jr.
8,424,251 B2 4/2013 Tinianov
8,490,349 B2 7/2013 Lutzner
8,505,259 B1 8/2013 Degtyarev
8,539,732 B2 9/2013 Leahy
8,555,581 B2 10/2013 Amend
8,555,589 B2 10/2013 Semmens et al.
8,555,598 B2 10/2013 Wagner et al.
8,621,806 B2 1/2014 Studebaker et al.
8,621,818 B1 1/2014 Glenn et al.
8,631,616 B2 1/2014 Carrion et al.
8,733,046 B2 5/2014 Naidoo
8,769,891 B2 7/2014 Kelly
8,826,613 B1 9/2014 Chrien
8,833,025 B2 9/2014 Krause
8,950,132 B2 2/2015 Collins et al.
8,966,845 B1 3/2015 Ciuperca
8,978,324 B2 3/2015 Collins et al.
8,991,111 B1 3/2015 Harkins
8,997,424 B1 4/2015 Miller
9,027,307 B2 5/2015 Collins et al.
9,382,709 B2 7/2016 Collins et al.
9,637,911 B2 5/2017 Doupe et al.
9,683,361 B2 6/2017 Timberlake et al.
10,041,289 B2 8/2018 Collins et al.
10,273,686 B2 4/2019 Lake
10,323,428 B2 6/2019 Collins et al.
10,370,851 B2 8/2019 Bodwell et al.
10,501,929 B2 12/2019 Henry
10,731,330 B2 8/2020 Petricca
2002/0059763 A1 5/2002 Wong
2002/0092703 A1 7/2002 Gelin et al.
2002/0134036 A1 9/2002 Daudet et al.
2002/0170243 A1 11/2002 Don

(56) References Cited

U.S. PATENT DOCUMENTS

2002/0184836 A1* 12/2002 Takeuchi ..... E04B 1/2403 52/167.1
2003/0005653 A1 1/2003 Sataka
2003/0056445 A1 3/2003 Cox
2003/0084629 A1 5/2003 Strickland et al.
2003/0101680 A1 6/2003 Lee
2003/0140571 A1 7/2003 Muha et al.
2003/0167712 A1 9/2003 Robertson
2003/0167719 A1 9/2003 Alderman
2003/0200706 A1* 10/2003 Kahan ..... E04H 9/02 52/167.3
2003/0221381 A1 12/2003 Ting
2004/0065036 A1 4/2004 Capozzo
2004/0103596 A1 6/2004 Don
2004/0221518 A1 11/2004 Westra
2005/0081484 A1 4/2005 Yland
2005/0108957 A1 5/2005 Quesada
2005/0188626 A1 9/2005 Johnson
2005/0188632 A1 9/2005 Rosen
2005/0198919 A1 9/2005 Hester, Jr.
2005/0204697 A1 9/2005 Rue
2005/0204699 A1 9/2005 Rue
2005/0210764 A1 9/2005 Foucher et al.
2005/0210798 A1 9/2005 Burg et al.
2005/0235571 A1 10/2005 Ewing et al.
2005/0235581 A1 10/2005 Cohen
2005/0247013 A1 11/2005 Walpole
2005/0262771 A1 12/2005 Gorman
2006/0021289 A1 2/2006 Elmer
2006/0070321 A1 4/2006 Au
2006/0090326 A1 5/2006 Corbett
2006/0096202 A1 5/2006 Delzotto
2006/0117689 A1 6/2006 Onken et al.
2006/0137293 A1 6/2006 Klein
2006/0143856 A1 7/2006 Rosko et al.
2006/0150521 A1 7/2006 Henry
2006/0179764 A1 8/2006 Ito
2006/0248825 A1 11/2006 Garringer
2006/0277841 A1 12/2006 Majusiak
2007/0000198 A1 1/2007 Payne
2007/0074464 A1 4/2007 Eldridge
2007/0107349 A1 5/2007 Erker
2007/0151196 A1 7/2007 Boatwright
2007/0157539 A1 7/2007 Knigge et al.
2007/0163197 A1 7/2007 Payne et al.
2007/0209306 A1 9/2007 Andrews et al.
2007/0234657 A1 10/2007 Speyer et al.
2007/0251168 A1 11/2007 Turner
2007/0283640 A1 12/2007 Shivak et al.
2007/0294954 A1 12/2007 Barrett
2008/0000177 A1 1/2008 Siu
2008/0057290 A1 3/2008 Guevara et al.
2008/0092472 A1 4/2008 Doerr et al.
2008/0098676 A1 5/2008 Hutchens
2008/0099283 A1 5/2008 Reigwein
2008/0104901 A1 5/2008 Olvera
2008/0168741 A1 7/2008 Gilgan
2008/0178542 A1 7/2008 Williams
2008/0178642 A1 7/2008 Sanders
2008/0190053 A1 8/2008 Surowiecki
2008/0202048 A1 8/2008 Miller et al.
2008/0222981 A1 9/2008 Gobbi
2008/0229669 A1 9/2008 Abdollahzadeh et al.
2008/0245007 A1 9/2008 McDonald
2008/0279620 A1 11/2008 Berg
2008/0282626 A1 11/2008 Powers, Jr.
2008/0289265 A1 11/2008 Lessard
2008/0295443 A1 12/2008 Simmons
2008/0295450 A1 12/2008 Yogev
2009/0031652 A1 2/2009 Ortega Gatalan
2009/0038764 A1 2/2009 Pilz
2009/0064611 A1 3/2009 Hall et al.
2009/0077916 A1 3/2009 Scuderi et al.
2009/0090074 A1 4/2009 Klein
2009/0100760 A1 4/2009 Ewing
2009/0100769 A1 4/2009 Barrett
2009/0100796 A1 4/2009 Denn et al.
2009/0107065 A1 4/2009 LeBlang
2009/0113820 A1 5/2009 Deans
2009/0134287 A1 5/2009 Klosowski
2009/0165399 A1 7/2009 Campos Gines
2009/0188192 A1 7/2009 Studebaker et al.
2009/0188193 A1 7/2009 Studebaker et al.
2009/0205277 A1 8/2009 Gibson
2009/0249714 A1 10/2009 Combs et al.
2009/0277122 A1 11/2009 Howery et al.
2009/0282766 A1 11/2009 Roen
2009/0283359 A1 11/2009 Ravnaas
2009/0293395 A1 12/2009 Porter
2009/0313931 A1 12/2009 Porter
2010/0050556 A1 3/2010 Burns
2010/0058686 A1 3/2010 Henriquez
2010/0064590 A1 3/2010 Jones et al.
2010/0064601 A1 3/2010 Napier
2010/0146874 A1 6/2010 Brown
2010/0146893 A1 6/2010 Dickinson
2010/0186313 A1 7/2010 Stanford et al.
2010/0212255 A1 8/2010 Lesoine
2010/0218443 A1 9/2010 Studebaker
2010/0229472 A1 9/2010 Malpas
2010/0235206 A1 9/2010 Miller et al.
2010/0263308 A1 10/2010 Olvera
2010/0275544 A1 11/2010 Studebaker et al.
2010/0313518 A1 12/2010 Berg
2010/0325971 A1 12/2010 Leahy
2010/0325989 A1 12/2010 Leahy
2011/0023381 A1 2/2011 Weber
2011/0041411 A1 2/2011 Aragon
2011/0056147 A1 3/2011 Beaudet
2011/0113709 A1 5/2011 Pilz
2011/0113715 A1 5/2011 Tonyan et al.
2011/0126484 A1 6/2011 Carrion et al.
2011/0146180 A1 6/2011 Klein et al.
2011/0154766 A1 6/2011 Kralic et al.
2011/0162167 A1 7/2011 Blais
2011/0219720 A1 9/2011 Strickland et al.
2011/0247281 A1 10/2011 Pilz et al.
2011/0268916 A1 11/2011 Pardue, Jr.
2011/0296769 A1* 12/2011 Collins ..... E04B 1/003 52/79.1
2011/0296778 A1 12/2011 Collins et al.
2011/0296789 A1 12/2011 Collins et al.
2011/0300386 A1 12/2011 Pardue, Jr.
2012/0073227 A1 3/2012 Urusoglu
2012/0096800 A1 4/2012 Berg
2012/0137610 A1 6/2012 Knight et al.
2012/0151869 A1 6/2012 Miller
2012/0167505 A1 7/2012 Krause
2012/0186174 A1 7/2012 LeBlang
2012/0210658 A1 8/2012 Logan
2012/0291378 A1 11/2012 Schroeder et al.
2012/0297712 A1 11/2012 Lutzner et al.
2012/0317923 A1 12/2012 Herdt et al.
2013/0025222 A1 1/2013 Mueller
2013/0025966 A1 1/2013 Nam et al.
2013/0036688 A1 2/2013 Gosain
2013/0067832 A1* 3/2013 Collins ..... E04B 1/24 52/125.1
2013/0111840 A1 5/2013 Bordener
2013/0133277 A1 5/2013 Lewis
2013/0232887 A1 9/2013 Donnini
2014/0013678 A1 1/2014 Deverini
2014/0013684 A1 1/2014 Kelly et al.
2014/0013695 A1 1/2014 Wolynski et al.
2014/0047780 A1 2/2014 Quinn et al.
2014/0059960 A1 3/2014 Cole
2014/0069035 A1 3/2014 Collins et al.
2014/0069040 A1 3/2014 Gibson
2014/0069050 A1 3/2014 Bolin
2014/0083046 A1 3/2014 Yang
2014/0090323 A1 4/2014 Glancy
2014/0130441 A1 5/2014 Sugihara et al.
2014/0317841 A1 10/2014 Dejesus et al.
2014/0338280 A1 11/2014 Tanaka et al.

(56) References Cited

U.S. PATENT DOCUMENTS

| | | | | |
|---|---|---|---|---|
| 2015/0007415 | A1 | 1/2015 | Kalinowski | |
| 2015/0093184 | A1 | 4/2015 | Henry | |
| 2015/0096251 | A1 | 4/2015 | McCandless et al. | |
| 2015/0121797 | A1 | 5/2015 | Brown et al. | |
| 2015/0128518 | A1 | 5/2015 | Knight et al. | |
| 2015/0136361 | A1 | 5/2015 | Gregory | |
| 2015/0152634 | A1 | 6/2015 | Unger | |
| 2015/0211227 | A1 | 7/2015 | Collins et al. | |
| 2015/0233108 | A1 | 8/2015 | Eggleston, II et al. | |
| 2015/0252558 | A1 | 9/2015 | Chin | |
| 2015/0284950 | A1 | 10/2015 | Stramandinoli | |
| 2015/0297926 | A1 | 10/2015 | Dzegan | |
| 2015/0308096 | A1* | 10/2015 | Merhi | B66D 3/18 52/125.1 |
| 2016/0002912 | A1 | 1/2016 | Doupe et al. | |
| 2016/0053475 | A1 | 2/2016 | Locker et al. | |
| 2016/0122996 | A1 | 5/2016 | Timberlake et al. | |
| 2016/0145933 | A1 | 5/2016 | Condon et al. | |
| 2016/0258160 | A1* | 9/2016 | Radhouane | E04C 3/29 |
| 2016/0290030 | A1 | 10/2016 | Collins et al. | |
| 2016/0319534 | A1 | 11/2016 | Bernardo | |
| 2017/0037613 | A1 | 2/2017 | Collins et al. | |
| 2017/0284095 | A1 | 10/2017 | Collins et al. | |
| 2017/0299198 | A1 | 10/2017 | Collins et al. | |
| 2017/0306624 | A1 | 10/2017 | Graham et al. | |
| 2017/0306625 | A1 | 10/2017 | Collins et al. | |
| 2018/0038103 | A1 | 2/2018 | Neumayr | |
| 2018/0148926 | A1 | 5/2018 | Lake | |
| 2018/0209136 | A1 | 7/2018 | Aylward et al. | |
| 2018/0223521 | A1 | 8/2018 | Uno et al. | |
| 2018/0328056 | A1 | 11/2018 | Collins et al. | |
| 2019/0032327 | A1 | 3/2019 | Musson | |
| 2019/0119908 | A1 | 4/2019 | Petricca | |
| 2019/0136508 | A1 | 5/2019 | Chaillan | |
| 2019/0249409 | A1 | 8/2019 | Boyd et al. | |
| 2020/0224407 | A1 | 7/2020 | Ng | |

FOREIGN PATENT DOCUMENTS

| | | | | |
|---|---|---|---|---|
| CN | 1313921 | 9/2001 | | |
| CN | 1234087 | 11/2002 | | |
| CN | 1742144 | 3/2006 | | |
| CN | 20137279 | 3/2008 | | |
| CN | 101426986 | 5/2009 | | |
| CN | 101821462 | 9/2010 | | |
| CN | 101831963 | 9/2010 | | |
| CN | 102105642 | 6/2011 | | |
| CN | 201952944 | 8/2011 | | |
| CN | 2021172020 | 1/2012 | | |
| CN | 102459775 | 5/2012 | | |
| CN | 102587693 | 7/2012 | | |
| CN | 202299241 | 7/2012 | | |
| CN | 202391078 | 8/2012 | | |
| CN | 102733511 | 10/2012 | | |
| CN | 205024886 | 2/2016 | | |
| CN | 206070835 | 4/2017 | | |
| CN | 108487464 | 9/2018 | | |
| DE | 4205812 | 9/1993 | | |
| DE | 9419429 | 2/1995 | | |
| DE | 20002775 | 8/2000 | | |
| DE | 19918153 | 11/2000 | | |
| DE | 20315506 | 11/2004 | | |
| DE | 202008007139 | 10/2009 | | |
| EP | 0612896 | 8/1994 | | |
| EP | 1045078 | 10/2000 | | |
| EP | 0235029 | 2/2002 | | |
| EP | 1375804 | 1/2004 | | |
| EP | 1568828 | 8/2005 | | |
| EP | 2128353 | 12/2009 | | |
| EP | 2213808 | 8/2010 | | |
| EP | 2238872 | 10/2010 | | |
| EP | 1739246 | 1/2011 | | |
| EP | 2281964 | 2/2011 | | |
| EP | 3133220 | 2/2017 | | |
| FR | 1317681 | 5/1963 | | |
| FR | 2988749 | 10/2013 | | |
| FR | 2765906 | 1/2019 | | |
| GB | 898905 | 6/1962 | | |
| GB | 2481126 | 12/2011 | | |
| JP | S46-006980 | 12/1971 | | |
| JP | S49-104111 | 9/1974 | | |
| JP | 52-015934 | 4/1977 | | |
| JP | 53-000014 | 1/1978 | | |
| JP | 53-156364 | 12/1978 | | |
| JP | 54-084112 | 6/1979 | | |
| JP | S54-145910 | 11/1979 | | |
| JP | 56-131749 | 10/1981 | | |
| JP | 57-158451 | 9/1982 | | |
| JP | S59-065126 | 5/1984 | | |
| JP | S60-019606 | 2/1985 | | |
| JP | 61-144151 | 9/1986 | | |
| JP | S61-201407 | 12/1986 | | |
| JP | S6358035 | 3/1988 | | |
| JP | H01-153013 | 10/1989 | | |
| JP | H0310985 | 1/1991 | | |
| JP | H049373 | 3/1992 | | |
| JP | 6-12178 | 2/1994 | | |
| JP | 06-212721 | 8/1994 | | |
| JP | H06220932 | 8/1994 | | |
| JP | 07-052887 | 6/1995 | | |
| JP | H07-173893 | 7/1995 | | |
| JP | 8-189078 | 7/1996 | | |
| JP | H08189078 | 7/1996 | | |
| JP | H09228510 | 9/1997 | | |
| JP | 2576409 | 4/1998 | | |
| JP | 10234493 | 9/1998 | | |
| JP | 11-117429 | 4/1999 | | |
| JP | H11-100926 | 4/1999 | | |
| JP | 2000-34801 | 2/2000 | | |
| JP | 2000144997 | 5/2000 | | |
| JP | 2000-160861 | 6/2000 | | |
| JP | 2000160861 | 6/2000 | | |
| JP | 3137760 | 2/2001 | | |
| JP | 3257111 | 2/2002 | | |
| JP | 2002-309691 | 10/2002 | | |
| JP | 2002536615 | 10/2002 | | |
| JP | 2002364104 | 12/2002 | | |
| JP | 2003-505624 | 2/2003 | | |
| JP | 2003-278300 | 10/2003 | | |
| JP | 2003-293493 | 10/2003 | | |
| JP | 2003278300 | 10/2003 | | |
| JP | 2004108031 | 4/2004 | | |
| JP | 2004-344194 | 12/2004 | | |
| JP | 3664280 | 6/2005 | | |
| JP | 2006-161406 | 6/2006 | | |
| JP | 2006161406 | 6/2006 | | |
| JP | 3940621 | 7/2007 | | |
| JP | 3137760 | 12/2007 | | |
| JP | 2008-063753 | 3/2008 | | |
| JP | 2008073434 | 4/2008 | | |
| JP | 2008110104 | 5/2008 | | |
| JP | 2009-257713 | 11/2009 | | |
| JP | 2010-185264 | 8/2010 | | |
| JP | 2010245918 | 10/2010 | | |
| JP | 2011-032802 | 2/2011 | | |
| JP | 2011032802 | 2/2011 | | |
| JP | 3187449 | 11/2013 | | |
| JP | 2015-117502 | 6/2015 | | |
| KR | 1019990052255 | 7/1999 | | |
| KR | 1019990053902 | 7/1999 | | |
| KR | 100236196 | 12/1999 | | |
| KR | 102000200413000 | 10/2000 | | |
| KR | 20060066931 | 6/2006 | | |
| KR | 20080003326 | 8/2008 | | |
| KR | 101481790 | 1/2015 | | |
| KR | 20180092677 | 8/2018 | | |
| WO | 1991007557 | 5/1991 | | |
| WO | 1997022770 | 6/1997 | | |
| WO | 200046457 | 8/2000 | | |
| WO | 0058583 | 10/2000 | | |
| WO | 2002/035029 | 5/2002 | | |
| WO | 2002035029 | 5/2002 | | |
| WO | WO-2006091864 | A2 * | 8/2006 | E04C 2/044 |

(56) References Cited

FOREIGN PATENT DOCUMENTS

| | | | | |
|---|---|---|---|---|
| WO | 2007059003 | | 5/2007 | |
| WO | 2007080561 | | 7/2007 | |
| WO | 2008/113207 | | 9/2008 | |
| WO | 2010030060 | | 3/2010 | |
| WO | 2010037938 | | 4/2010 | |
| WO | 2011015681 | | 2/2011 | |
| WO | 2011/116622 | | 9/2011 | |
| WO | 2015050502 | | 4/2015 | |
| WO | 2016/033429 | | 3/2016 | |
| WO | 2016032537 | | 3/2016 | |
| WO | 2016032538 | | 3/2016 | |
| WO | 2016032539 | | 3/2016 | |
| WO | 2016032540 | | 3/2016 | |
| WO | 2016033429 | | 3/2016 | |
| WO | 2016033525 | | 3/2016 | |
| WO | WO-2016032538 | A1 * | 3/2016 | ..... E04H 9/024 |
| WO | WO-2016032540 | A1 * | 3/2016 | ..... E04B 1/14 |

OTHER PUBLICATIONS

EPO, Extended European Search Report for European Patent Application No. 17763913.5, dated Oct. 16, 2019, 8 pages.
EPO, Partial European Search Report for European Patent Application No. 17763910.1, dated Oct. 17, 2019, 16 pages.
EPO, Extended European Search Report for European Patent Application No. 17763907.7, dated Sep. 13, 2019, 13 pages.
WIPO, International Search Report and Written Opinion for PCT Application No. PCT/US2019/038557, dated Sep. 4, 2019, 67 pages.
U.S. Appl. No. 12/796,603, filed Jun. 8, 2010, Collins et al.
European Search Report in PCT/US2015/047383 dated Jun. 22, 2018, 10 Pages.
WIPO, International Search Report and Written opinion for International Application No. PCT/US/2014/053614 dated Dec. 18, 2014, 11 pages.
WIPO, International Search Report and Written opinion for International Application No. PCT/US/2014/053615 dated Dec. 17, 2014, 11 pages.
WIPO, International Search Report and Written opinion for International Application No. PCT/US/2014/053613 dated Dec. 18, 2014, 13 Pages.
WIPO, International Search Report and Written Opinion for International Application No. PCT/US2011/001039 dated Oct. 5, 2011, 14 Pages.
WIPO, International Search Report and Written opinion for International Application No. PCT/US2015/047383 dated Jan. 12, 2016, 14 Pages.
WIPO, International Search Report and Written opinion for International Application No. PCT/US15/47536 dated Dec. 4, 2015, 17 Pages.
European Search Report received for POT 14891125.8-1604/3011122 dated Jul. 8, 2016, 4 pages.
WIPO, International Search Report and Written opinion for International Application No. PCT/US/2014/053616 dated Dec. 17, 2014, 9 Pages.
WIPO, International Search Report and Written Opinion for PCT Application No. PCT/US2011/001039 dated Oct. 5, 2011, 9 Pages.
"Beam to column connection", TATA Steel, http://www.tatasteelconstruction.com/en/reference/teaching_resources/architectural_studio_reference/elements/connections/beam to column connections, 2014, 4 Pages.
"Emerging Trends 2012 Executive Summary", Urban Land Institute, Ch. 1, 2011, 1-11 Pages.
"Emerging Trends in real estate", accessed on Sep. 15, 2016 at https://web.archive.orgIweb120140813084823/http://pwc.corn.au/industry/real-estate/assets/Real-Estate-2012-Europe-Jan12.pdf, pp. 60 (2012).
"Extended European Search Report for European Application No. EP 15836516.3", dated Jun. 22, 2018, 1 page.
"Extended European Search Report for European Patent Application No. 14900469", dated Mar. 20, 2018, 1-8.
"How to Soundproof a Ceiling—Soundproofing Ceilings", http://www.soundproofingcompany.com/soundproofing-solutions/soundproof-a-ceiling/, Apr. 2, 2014, 1-7 Pages.
"Insulspan Installation Guide", Obtained at: http://www.insuispan.comidownloads:InstallationGuide,pdf on Feb. 2, 2016, 58 pages.
"Structural Insulated Panel", Wikipedia, http://www.en.wikipedia.org//wiki/Structural_insulated_panel, May 30, 2014, 5 Pages.
"Structural Insulated Panels", SIP Solutions, http://www.sipsolutions.com/content/structuralinsulated-panels, Aug. 15, 2014, 3 pages.
"US Apartment & Condominium Construction Forecast 2003-2017", Statista, Inc., Jun. 2012, 8 Pages.
Azari, et al., "Modular Prefabricated Residential Construction—Constraints and Opportunities", PNCCRE Technical Report #TR002, Aug. 2013, 90 Pages.
Borzouie, Jamaledin, et al., "Seismic Assesment and Reahbilitation of Diaphragms", http://www.nosazimadares.ir/behsazi/15WCEE2012/URM/1/Roof.pdf, Dec. 31, 2011, 86 Pages.
EPO, Communication Pursuant to Article 94(3) EPC mailed for EP application No. 15836516.3, dated Apr 25, 2019, 4 pages.
EPO, Communication Pursuant to Article 94(3) EPC for European Patent Application No. 15836516.3, dated Aug. 2, 2019, 4 pages.
EPO, Communication Pursuant to Article 94(3) EPC mailed for European patent application No. 14900469.9, dated Jun. 18, 2019, 5 pages.
Framecad, "FC EW 1—12mm Fibre Cement Sheet + 9mm MgO Board Wall Assembly", 2013, 2 pages.
Giles, et al., "Innovations in the Development of Industrially Designed and Manufactured Modular Concepts for Low-Energy, Multi-Story, High Density, Prefabricated Affordable Housing", Innovations in the Development of Industrially Designed and Manufactured Modular Concepts, 2006, 1-15 Pages.
Gonchar, "Paradigm Shift—Multistory Modular", Architectural Record, Oct. 2012, 144-148 Pages.
Kerin, et al., "National Apartment Market Report—2013", Marcus & Millichap, 2013, 1-9 pages.
M.A. Riusillo, "Lift Slab Construction: Its History, Methodology, Economics and Applications", ACI-Abstract, Jun. 1, 1988, 2 pages.
McIlwain, "Housing in America—The Next Decade", Urban Land Institute, 2010, 1-28 Pages.
McIlwain, "The Rental Boost From Green Design", Urban Land, http://urbanland.uli.org/sustainability/the-rental-boost-from-green-design/, Jan. 4, 2012, 1-6 Pages.
Shashaty, Andre, , "Housing Demand", Sustainable Communities, Apr. 2011, 14-18 Pages.
Sichelman, "Severe Apartment Shortage Looms", Urban Land, http://urbanland.uli.org/capital-markets/nahb-orlando-severe-apartment shortage-looms/, Jan. 13, 2011, 1-2 Pages.
Stiemer, S F, "Bolted Beam-Column Connections", http://faculty.philau.edu/pastorec/Tensile/bolted_beam_column_connections.pdf, Nov. 11, 2007, 1-16 Pages.
WIPO, International Search Report for International Patent Application No. PCT/US2017/021174, dated Jun. 26, 2017, 11 pages.
WIPO, International Search Report for International Patent Application No. PCT/US2017/021168, dated May 19, 2017, 5 pages.
WIPO, Written Opinion for International Patent Application No. PCT/US2017/021174, dated Jun. 26, 2017, 6 pages.
WIPO, International Search Report for International Patent Application No. PCT/US2017/021179, dated May 25, 2017, 7 pages.
WIPO, Written Opinion for International Patent Application No. PCT/US2017/021179, dated May 25, 2017, 7 pages.
WIPO, International Search Report of International Patent Application No. PCT/US2017/021177, dated Jun. 5, 2017, 8 pages.
WIPO, Written Opinion of International Patent Application No. PCT/US2017/021177, dated Jun. 5, 2017, 8 pages.
WIPO, Written Opinion for International Patent Application No. PCT/US2017/021168, dated May 19, 2017, 8 pages.
WIPO, International Search Report and Written Opinion mailed for International application No. PCT/US2019/031370, dated Aug. 7, 2019, 11 pages.
WIPO, International Search Report and Written Opinion mailed for International application No. PCT/US2015/047536 dated Dec. 4, 2015, 17 Pages.

(56) References Cited

OTHER PUBLICATIONS

EPO, Extended European Search Report for European Patent Application No. 17763914.3, dated Nov. 19, 2019, 10 pages.
EPO, Communication Pursuant to Article 94(3) EPC for European Patent Application No. 15836516.3, dated Jan. 15, 2020, 5 pages.
EPO, Extended European Search Report for European Patent Application No. 17763910.1, dated Jan. 28, 2020, 13 pages.
EPO, Extended European Search Report for European Patent Application No. 20201601.0, dated Mar. 16, 2021, 10 pages.

* cited by examiner

BUILDING SYSTEM WITH A DIAPHRAGM PROVIDED BY PRE-FABRICATED FLOOR PANELS

CROSS-REFERENCE TO RELATED APPLICATION

The present application is a non-provisional application that claims priority under 35 U.S.C. § 119(e) to U.S. Provisional Patent Application No. 62/505,692, filed on May 12, 2017, entitled "BUILDING SYSTEM WITH A DIAPHRAGM PROVIDED BY PRE-FABRICATED FLOOR PANELS," which is incorporated herein by reference in its entirety.

BACKGROUND

Conventional construction is mostly conducted in the field at the building job site. People in various trades (e.g., carpenters, electricians, and plumbers) measure, cut, and install material as though each unit were one-of-a-kind. Furthermore, activities performed by the trades are arranged in a linear sequence. The result is a time-consuming process that increases the risk of waste, installation imperfections, and cost overruns. One approach to improving efficiency in building construction may be modular construction. In the case of buildings with multiple dwelling units (e.g., apartments, hotels, student dorms, etc.), entire dwelling units (referred to as modules) may be built off-site in a factory and then trucked to the job site. The modules are then stacked and connected together, generally resulting in a low-rise construction (e.g., between one and six stories). Other modular construction techniques may involve the building of large components of the individual units off-site (e.g., in a factory) and assembling the large components in the field to reduce the overall construction effort at the job site and thereby reducing the overall time of erecting the building. However, shortcomings may exist with known modular building technologies and improvements thereof may be desirable.

SUMMARY

Techniques are generally described that include systems and methods relating to building construction and more specifically relating to constructing and coupling a diaphragm to an external structural frame of a building. The diaphragm may be constructed at least in part from a plurality of pre-assembled floor and ceiling panels (also referred to as floor-ceiling panels).

A building system according to some embodiments of the present disclosure may include an external structural frame including a plurality of columns and beam, a diaphragm including a plurality of floor panels, each of the plurality of floor panels having a longitudinal direction and a transverse direction, and wherein the plurality of floor panels are supported by a plurality of diaphragm beams arranged along the transverse direction, and a coupling assembly between each of the transverse beams and the external structural frame such that structural loads are transmitted from the diaphragm to the external structural frame only via the coupling assemblies between the transverse beams and the external structural frame.

In some embodiments of the building system, each of the plurality of diaphragm beams may be fire-rated. In some embodiments, each of the plurality of diaphragm beams may be filled with a mineral-based material, such as concrete. In some embodiments, each concrete-filled beam may include at least one internal metal re-enforcing member (e.g., rebar). In some embodiments of the building system, each of the plurality of floor-ceiling panels may be a pre-assembled panel comprising opposite longitudinal edges extending along the longitudinal direction, opposite lateral edges extending along the lateral direction, and a plurality of joist extending in the longitudinal direction in a spaced arrangement between the opposite longitudinal edges.

In some embodiments of the building system, a first one of the plurality of floor-ceiling panels may be pre-assembled to include a track extending along a first longitudinal edge of the first floor-ceiling panel, and the track may be configured to receive a floor-to-ceiling-window panel, and wherein the first floor-ceiling panel is unsupported by the external frame along the first longitudinal edge. In some embodiments, the track may be a first track attached to a floor side of the first floor-ceiling panel, and the first floor-ceiling panel may be pre-assembled to include a second track along the first longitudinal edge on a ceiling side of the first floor-ceiling panel, the second track being configured to receive another floor-to-ceiling window panel. In some embodiments, the first and second tracks are configured to slidably receive the respective floor-to-ceiling window panel.

In some embodiments, the first floor-ceiling panel may be pre-assembled to include a water impermeable member enclosing the first longitudinal edge. In some embodiments, the water impermeable member may be a plastic or a composite c-channel having an upper flange that extends fully under the first track and a lower flange that extends at least partially under the second track. In some embodiments, the upper flange may include a lip adjacent to an interior side of the first track and the lower flange may include a ledge adjacent to an exterior side of the second track. In some embodiments, the first floor-ceiling panel may include a second longitudinal edge configured to be coupled to a longitudinal edge of an adjacent floor-ceiling panel. As described, the first floor-ceiling panel may be unsupported by a beam of the external frame along the second longitudinal edge. In some embodiments, the plurality of floor-ceiling panels may include at least one middle floor-ceiling panel having first and second longitudinal edges connected to adjacent floor-ceiling panels, and the middle floor-ceiling panel may be unsupported by a beam of the external frame along both of the first and second longitudinal edges of the middle floor-ceiling panel. In some embodiments, the diaphragm may include a diaphragm edge opposite the first longitudinal edge of the first floor-ceiling panel, and a non-loadbearing wall may be coupled to the diaphragm along the diaphragm edge, for example a non-loadbearing wall that extends substantially the full length of the diaphragm edge.

In some embodiments, a first one of the plurality of diaphragm beams is coupled to a beam of the external structural frame and wherein a second one of the plurality of lateral beams is coupled to one of the plurality of columns of the external structural frame. In some embodiments, the first diaphragm beam may be a fire-rated beam which is parallel to a beam of the external structural frame. In some embodiments, the beams and/or columns of the external structural frame may not be fire-rated.

A method of assembling a building in accordance with some embodiments of the present disclosure may include erecting at least a portion of an external structural frame including a plurality of columns and a plurality of beams, wherein the plurality of beams includes at least a pair of first beams and a pair of second beams perpendicular to the pair of first beams, and assembling a diaphragm to the external structural frame. The assembling a diaphragm may include coupling each of a pair of diaphragm beams to the external structural frame, the diaphragm beams arranged parallel to the first beams of the external structural frame, and coupling a plurality of pre-assembled floor-ceiling panels to the pair of diaphragm beams such that each of the floor-ceiling panels is supported by the diaphragm beams along a transverse direction of the respective floor-ceiling panel and wherein each of the floor-ceiling panels is unsupported by any beam of the external structural frame along a longitudinal direction of the respective floor-ceiling panel.

In some embodiments, the coupling of each of the pair of diaphragm beams to the external structural frame may include coupling at least one of the pair of diaphragm beams directly to a pair of columns of the external structural frame. In some embodiments, the coupling of each of the pair of diaphragm beams to the external structural frame may include coupling one of the pair of diaphragm beams directly to the pair of second beams. In some embodiments, the coupling of the plurality of pre-assembled floor-ceiling panels to the pair of diaphragm beams may include coupling each floor-ceiling panel in the plurality in sequence. In some embodiments, the sequence may include coupling a first floor-ceiling panel including a window track to the pair of diaphragm beams, and coupling a second floor-ceiling panel to the pair of lateral beams and to the first floor-ceiling panel. In some embodiments, the sequence may further include coupling a third floor-ceiling panel to the pair of diaphragm beams and to the second floor-ceiling panel, the third floor-ceiling panel including at least one plumbing component. In some embodiments, the plurality of pre-assembled floor-ceiling panels is a first plurality of pre-assembled floor-ceiling panels, and the assembling a diaphragm may further include coupling an additional diaphragm beam to the external structural frame, and coupling a second plurality of pre-assembled floor-ceiling panels to one of the pair of diaphragm beams and the additional diaphragm beam. In further embodiments, each of the pair of diaphragm beams and the additional diaphragm beam may be coupled to the external structural frame prior to coupling any of the floor-ceiling panels of the first and second pluralities to the diaphragm beams.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1:
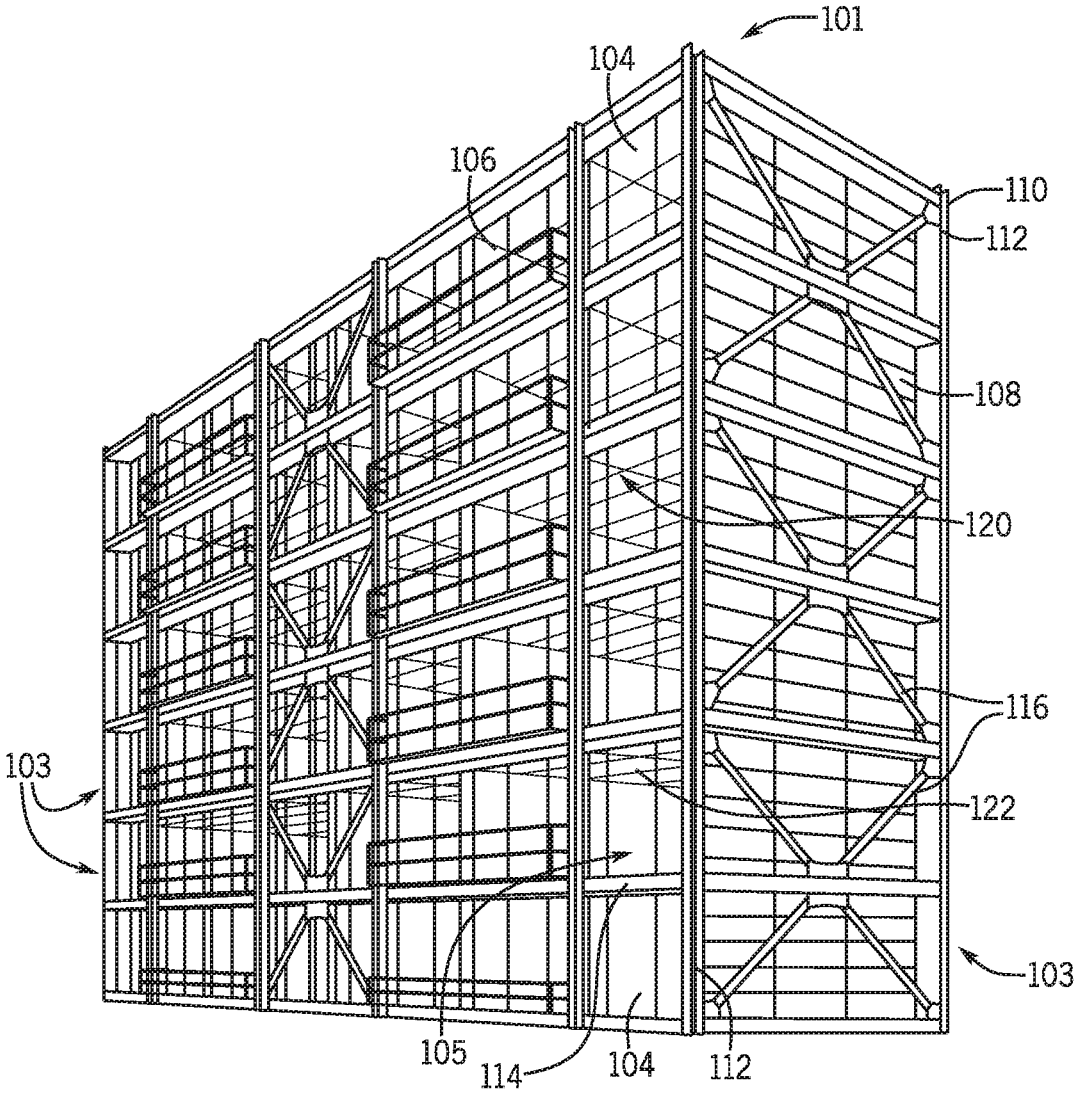
FIG. 1 is an illustration of an example multi-story building.

all arranged in accordance with at least some examples of the present disclosure.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatus generally related to pre-assembled panels for use in a building and to building systems which include a diaphragm provided by one or more pre-assembled panels. In some examples, the pre-assembled panel may be assembled off-site in a shop and then transported to the building site for assembly into the building system. At the building site, the pre-assembled panel may be attached directly or indirectly to a building frame. The building frame may be an external frame. The term external frame, also referred to as external structural frame, will be understood to refer to a structural frame of a building which is arranged generally externally to the envelope of the building. This is, in contrast to other types of structural frames that include vertical and horizontal load bearing members located within the perimeter defined by the building envelope, as is typical in timber construction for example, the external frame is arranged outside the perimeter of the building envelope. As is generally known in the field of structural engineering, the structural frame is the load-resisting or load-bearing system of a building which transfers loads (e.g., vertical and lateral loads) into the foundation of the building trough interconnected structural components (e.g., load bearing members, such as beams, columns, load-bearing walls, etc.). The design and construction of a building with an external frame may have advantages over internally framed buildings but may also bring new challenges, some of which may be addressed by examples of the present disclosure.

For example, building regulations in countries around the world impose requirements for the design and construction of buildings to ensure the safety to occupants of the building.

In many countries, these regulations (also referred to as building codes), require that a building be designed and constructed such that, for example in case of a fire, the stability of the building (e.g., its load bearing capacity) is maintained for a reasonable period of time (e.g., a time sufficient to allow the occupants to egress the building). Therefore, typically, building codes in many countries impose fire proofing requirements to any load bearing structure (e.g., vertical and horizontal load bearing members). Modern steel framed buildings are sometimes constructed with external structural frames, i.e., where the structural frame on the outside of the facade, that is external to the building's envelope. In the event of a fire, an external structural frame may thus be heated only by flames emanating from windows or other openings in the building facade and the fire exposure to the external steelwork may thus be much less severe as compared to what the steel inside the building experiences. In some such cases, and depending on the design of the building and frame, the external frame, or at least some components thereof, may not need to be fire-proofed as is generally required any steel frame members located within the interior to the building. Thus using an external frame may in some cases significantly reduce construction costs by reducing the amount of fireproofing materials (e.g., spray on fire resistive materials and/or intumescent paint) required to meet code.

In some examples of the present disclosure, a building system may include a diaphragm attached to an external structural frame in a manner designed to reduce the amount of fireproofing material that may otherwise be required to meet code. The diaphragm of the building system may be provided by one or more, and typically a plurality, of pre-assembled floor panels. The use of pre-assembled floor panels may obviate the need for using concrete slab construction as is typically done, e.g., in mid- and high-rise construction. That is, in examples of the present disclosure, the diaphragm, which may provide a floor system of a building, may be constructed from pre-assembled floor panels without the use of a concrete slab, which may further improve the cost/efficiency of erecting the building by removing a step in a conventional building construction process (e.g., the concrete slab pouring/curing step). Additionally, the pre-assembled floor panels may be arranged in a manner that reduces the overall use of structural steel needed to support and transfer loads from the diaphragm to the external frame. Pre-assembled panels for use in a diaphragm according to the present disclosure may define part of or the whole of a floor and part of or the whole of a ceiling in the building, such as part of or the whole of a floor and ceiling of a building unit. Thus, in some examples, such pre-assembled panel may interchangeably be referred to herein as a floor and ceiling panel, a floor-ceiling panel, or a floor ceiling sandwich (FCS) panel. The floor may be a portion of a story of the building above the panel, and the ceiling may be a portion of a story of the building below the panel.

The pre-assembled panel(s) used in a diaphragm according to some embodiments may include a floor-panel frame, a floor panel, and a ceiling panel. The floor and ceiling panels may be spaced from one another by the floor-panel frame. The floor-panel frame may separate the floor panel from the ceiling panel. The floor-panel frame may include a plurality of joists positioned between the floor panel and the ceiling panel. The floor-panel frame may define one or more joist cavities between adjacent joists. In some examples, the one or more joist cavities may accommodate plumbing, cabling, wiring, or other conduits or other elements that may support dwelling or commercial units in the buildings. An insulative material may be located in the one or more joist cavities. In some examples, cross members may be provided in or operatively arranged relative to the one or more joist cavities, for example for increasing the lateral stability of the panel. In some examples, the cross members may be implemented in the form of straps, such as metal straps, connected between opposite corners of a joist cavity. Sound dampener material (also referred to as sound insulative material) may be positioned between the floor-panel frame, the floor panel, and the ceiling panel to reduce sound transmission through the floor and ceiling panel.

The floor panel may be attached to an upper side of the frame, also referred to as floor side of the frame. The floor panel may support a floor material (e.g., a floor finish such as tile, hardwood, manufactured wood, laminate or others) of an upper story. The floor panel may be formed of one or more layers of non-combustible material and may include a radiant heating element. The ceiling panel may be formed of one or more layers of non-combustible materials and may be attached to a lower side of the frame, also referred to as ceiling side of the frame. The ceiling panel may support a ceiling material (e.g., a ceiling finish such as ceiling tiles or other type of finish as may be desired) of a lower story. In some embodiments, the floor-ceiling panels may be implemented in accordance with any of the examples described in co-pending international patent application PCT/US17/21168, titled "Floor and Ceiling Panel for Slab-free Floor System of a Building," which application is incorporated is incorporated herein by reference in its entirety for any purpose.

In some embodiments, the material composition of the floor-panel frame may be predominantly metal. In some embodiments it may be predominately aluminum. In still other embodiments, floor-ceiling panel components may be made from a variety of building suitable materials ranging from metals, to wood and wood polymer composites (WPC), wood based products (lignin), other organic building materials (bamboo) to organic polymers (plastics), to hybrid materials, or earthen materials such as ceramics. In some embodiments cement or other pourable or moldable building materials may also be used. In other embodiments, any combination of suitable building material may be combined by using one building material for some elements of the panel and other building materials for other elements of the panel. Selection of any material may be made from a reference of material options (such as those provided for in the International Building Code), or selected based on the knowledge of those of ordinary skill in the art when determining load bearing requirements for the structures to be built. Larger and/or taller structures may have greater physical strength requirements than smaller and/or shorter buildings. Adjustments in building materials to accommodate size of structure, load and environmental stresses can determine optimal economical choices of building materials used for all components in the system described herein. Availability of various building materials in different parts of the world may also affect selection of materials for building the panel described herein. Adoption of the International Building Code or similar code may also affect choice of materials.

Any reference herein to "metal" includes any construction grade metals or metal alloys as may be suitable for fabrication and/or construction of the system and components described herein. Any reference to "wood" includes wood, wood laminated products, wood pressed products, wood polymer composites (WPCs), bamboo or bamboo related products, lignin products and any plant derived product, whether chemically treated, refined, processed or simply harvested from a plant. Any reference herein to "concrete" includes any construction grade curable composite that includes cement, water, and a granular aggregate. Granular aggregates may include sand, gravel, polymers, ash and/or other minerals.

In referring now to the drawings, repeating units of the same kind or generally fungible kind, are designated by the part number and a letter (e.g. 214*n*), where the letters "a", "b" and so on refer to a discrete number of the repeating items. General reference to the part number followed by the letter "n" indicates there is no predetermined or established limit to the number of items intended. The parts are listed as "a-n" referring to starting at "a" and ending at any desired number "n".

FIG. 1 illustrates a building system in accordance with at least some embodiments of the present disclosure. FIG. 1 shows building 101, which may include an external structural frame 110 and a diaphragm 120 in accordance with the present disclosure. FIG. 1 shows stories 103 and units 105 of the building 101, columns 112, beams 114, and cross braces 116 of the external structural frame 110, as well as floor-ceiling panels 122, window panels 104, interior (or demising) walls 106, and end walls 108. The various components and arrangement thereof shown in FIG. 1 is merely illustrative, and other variations, including eliminating components, combining components, and substituting components, or rearranging components are all contemplated.

The building 101 may include two or more stories or levels 103. The envelope of the building 101 may be defined by exterior walls and windows, e.g., by end walls 108, window panels 104, which may include floor to ceiling window panels defining a window wall, and/or utility walls (not shown in this view). These walls may be referred to as the building's exterior or envelope walls. The interior of the building 101 may be divided into one or more dwelling or commercial units 105 and/or one or more rooms of a unit using interior walls, also referred to as demising walls 106. In embodiments of the present disclosure, the various walls (e.g., demising walls 106, end walls 108, and window walls) of the building 101 may not be load bearing walls. Rather, structural loads may be transferred to and carried by the external structural frame 110. Structural loads (e.g., lateral loads from wind and/or earthquakes) may be transferred to the external structural frame 110 via the diaphragm 120, as will be further described.

The building 101 may be classified as a low-rise, mid-rise, or high-rise construction depending on the number of stories (each city or zoning authority may define building heights in any fashion they deem proper). The building 101 may include, as part of the diaphragm 120, one or more floor-ceiling panels 122. A floor-ceiling panel as described herein may be suitable for use in a building of any number of stories (levels), including a mid-rise building and a high-rise building. In some embodiments, the building may be a residential multi-dwelling building having six, seven, eight or more stories, and in some example twenty five, thirty five, fourth five, or more stories (e.g., as in high-rise or skyscraper construction).

As shown and described, the building 101 may include an external structural frame 110. The external frame 110 may serve as a structural exoskeleton of the building 101. The external frame 110 may include multiple columns 112 (also referred to as frame columns), beams 114 (also referred to as frame beams), and/or cross braces 116. The columns 112 are oriented vertically, the beams 114 are oriented horizontally, and the cross braces 116 may be oriented horizontally or obliquely to the columns 112. For example cross braces may be horizontally oriented (e.g., as the frame beams 114) connecting adjacent columns, or they may be obliquely oriented to the columns and/or beams, e.g., as the cross-braces 116 illustrated in the example in FIG. 1. The beams 114 may extend between and be attached to adjacent columns 112 to connect the adjacent columns 112 to one another. The cross braces 116 may extend between and be attached to one or more of the beams 114, columns 112, or a combination thereof, to provide additional stiffness to the external frame 110. As described, in various embodiments, the external frame 110 may provide the structural support for the building 102, while some or all of the walls of the building may generally be non-load bearing walls. That is, in embodiments herein, the frame columns, frame beams, and cross braces may be arranged to provide most or substantially all the structural support or load-bearing capability for building 101 and the diaphragm 120 may be designed to transfer loads to the structural frame, whereby the load is then carried into the foundation of the building.

The building 101 may include multiple units or modules 105 disposed internally of the external frame 110. The units 105 may be commercial, residential (such as dwelling units), or a combination thereof (e.g., live-work units). The units may be standardized and repetitive, or unique and individualized. Mixed units of standard size and shape may be combined with unique units in the same floor, or in independent arrangement on separate floors. In some embodiments, a unit may encompass more than one floor. The units 105 may be assembled at the building site using multiple pre-assembled or pre-assembled components (e.g., pre-assembled floor-ceiling panels 122, prefabricated walls, etc.). The pre-assembled components may be assembled independent of one another remotely from the building site and transported to the building site for installation. The pre-assembled components may include, as delivered to the building site, most or all of the components to support the commercial or residential use of the units, e.g., electrical and/or plumbing conduits, heating and air conditioning ducting, etc. Thus, installation of sub-systems in the field may be reduced, thus again reducing the overall cost and construction timeline. The pre-assembled components may be attached to the external frame 110, to adjacent components, or both at the building site to erect the building 101 and form the individual units 105. In some embodiments, the building 101 may include internal support (e.g., load-bearing) structures. For example, the diaphragm 120 may include one or more support beams (see e.g., transverse beams 230 in FIGS. 2A and 2B), which may also be referred to herein as diaphragm beams. The diaphragm beams may support the one or more floor-ceiling panels 122 that form part of the diaphragm 120. The diaphragm beams may be attached to the external structural frame 110 (e.g., to a frame column and/or a frame beam) to transmit load from the diaphragm to the structural frame.

Pre-assembled components according to the present disclosure may include one or more pre-assembled or pre-assembled floor-ceiling panels 122 and one or more pre-assembled or pre-assembled walls (e.g., demising wall 106, end wall 108). The floor-ceiling panels 122 are oriented substantially horizontally to define the floor of an upper unit and the ceiling of a lower unit. Individual floor-ceiling panels 122 may be arranged horizontally and adjacent to one another along their longitudinal direction. The longitudinal direction may be the direction of longer length of a rectangular panel. The longitudinal direction may be the direction along which the joists run. The transverse direction may be direction of shorter length of a rectangular panel, i.e., the direction perpendicular to the longitudinal direction. The longitudinal and transverse directions refer to the planform shape of the panel, each panel also having a thickness direction which is perpendicular to the longitudinal and transverse directions. In some examples, the panels may be generally square in shape in which case the longitudinal direction may be the direction along which the joists run. Individual floor-ceiling panels 122 may be attached to one another, one or more columns, one or more beams, or any combination thereof. The individual floor-ceiling panels 122 may be coupled to and supported by diaphragm beams, which in turn may be coupled to the external frame, such as via a coupling assembly between a respective diaphragm beam and one or more beams 112 and/or columns 114 of the external frame 110 to transfer loads from the diaphragm 120 to the external frame 110. The walls (e.g., demising walls 106 and end walls 108) may be oriented substantially vertically to define the envelope of the building and/or partition each story into multiple units, a single unit into multiple rooms, or combinations thereof. The walls may be attached to the floor-ceiling panels 112 with fasteners and then caulked, sealed, or both. In some embodiments, some of the walls of building 101 may additionally or alternatively be attached to the diaphragm beams that support the floor-ceiling panels 112.

Figure 2A:
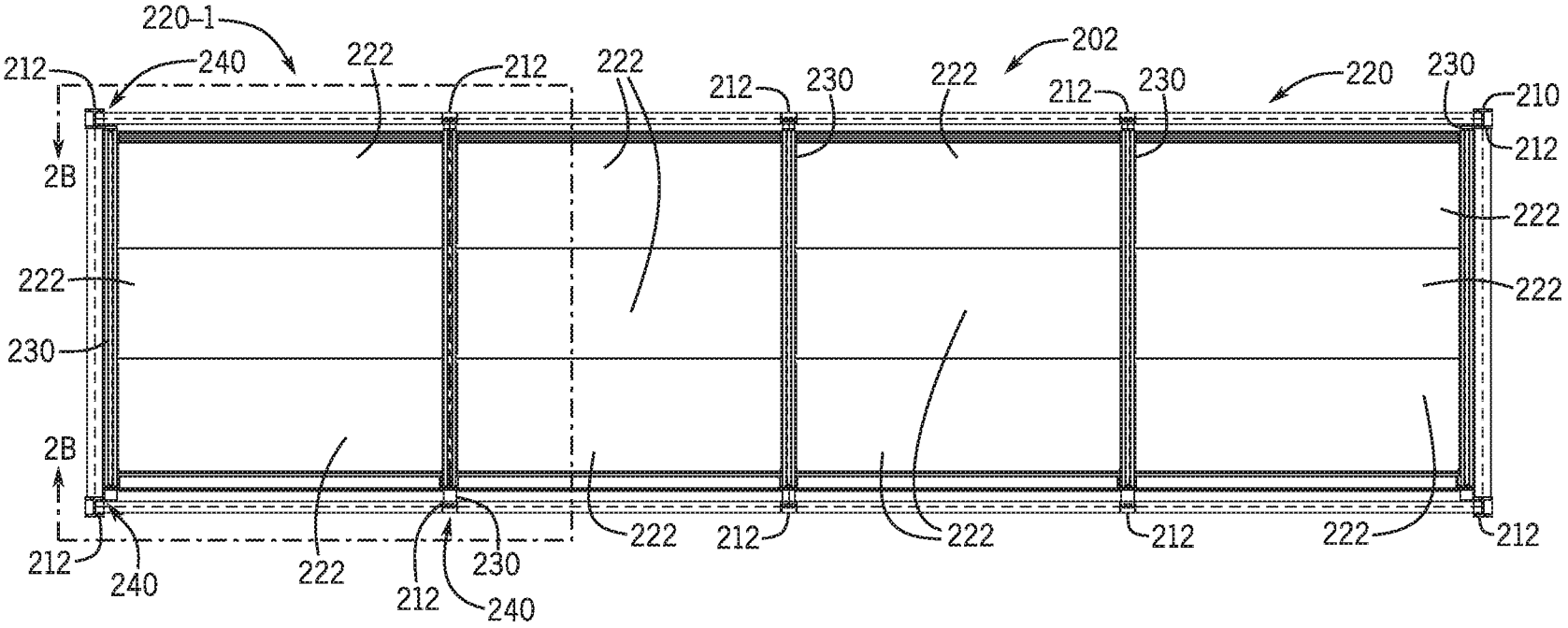
FIG. 2A is an illustration of a floor system of a building.
Figure 2B:
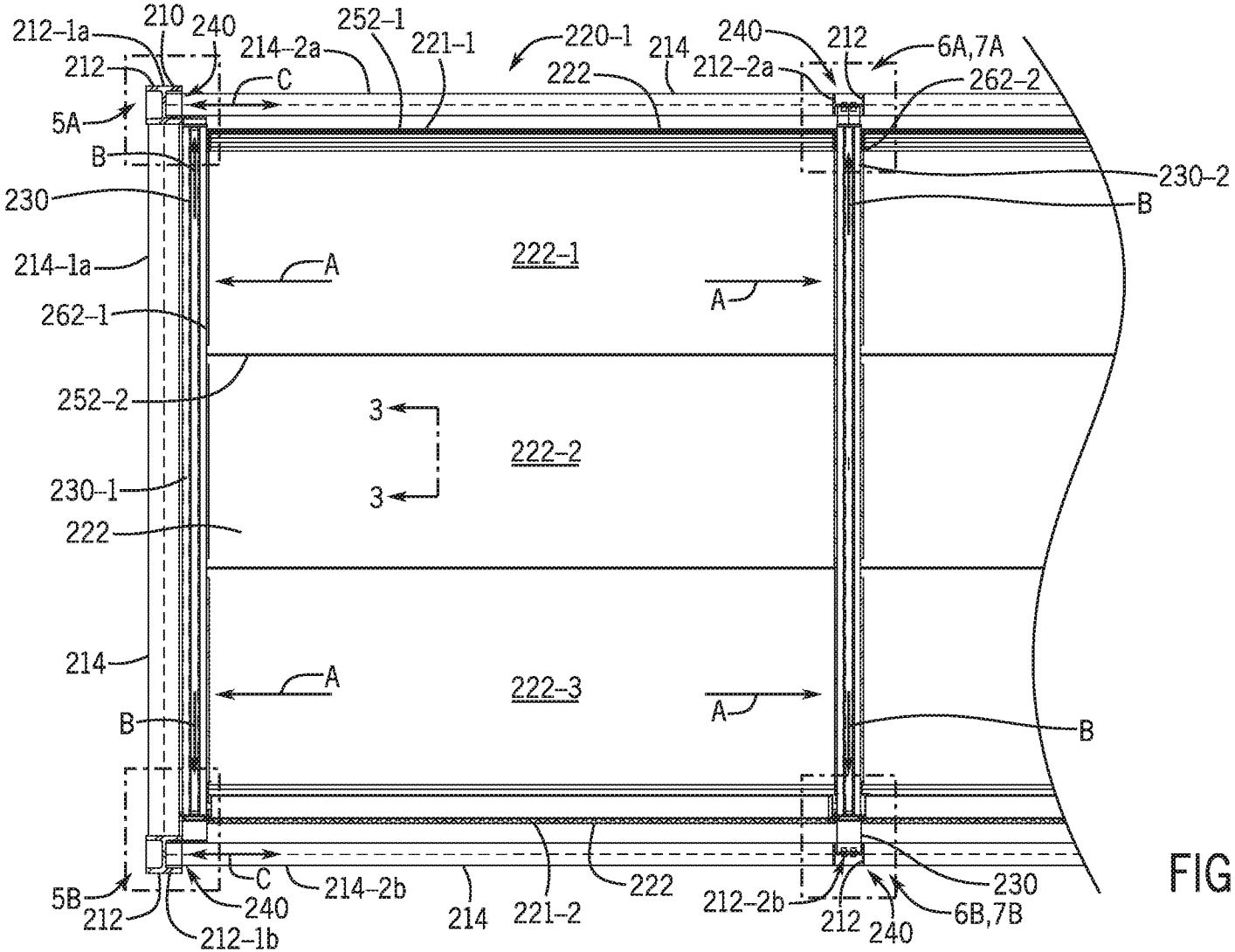
FIG. 2B is an illustration of a portion of the floor system in FIG. 2A.

FIGS. 2A and 2B illustrate an example diaphragm 220 arranged in accordance with the present disclosure. The diaphragm 220 may form part of the floor system 202 of a building, such as building 101 in FIG. 1. The diaphragm 220 may be used to implement the diaphragm 120 of the building 101 in FIG. 1. FIGS. 2A and 2B show, in plan view, external structural frame 210, a plurality of columns 212 including columns 212-1, 212-2, 212-3, and 212-4, a plurality of beams 214 including beams 214-1, 214-2, 214-3, diaphragm 220, a plurality of floor panels 222 including floor panels 222-1, 222-2 and 222-3, diaphragm beams 230, and a plurality of coupling assemblies 240. The various components and arrangement thereof shown in FIGS. 2A and 2B are merely illustrative, and other variations, including eliminating components, combining components, and substituting components, or rearranging components are all contemplated.

The floor system 202 may be part of a multi-story building (e.g., building 101 in FIG. 1) which includes an external structural frame 210. As described, the external frame 210 may serve as a structural exoskeleton of the building. The external frame 210 may include multiple columns 212 extending vertically from a foundation of the building. The columns 212 may be braced by beams 214, also referred to as frame beams to distinguish them from the diaphragm beams 230 employed in constructing the diaphragm as will be described, and/or oblique cross-braces (not shown in this view). The beams 214 may extend horizontally, connecting adjacent columns. As is generally known in building construction, buildings may include a variety of support systems arranged to withstand different forces applied to the building. For example, vertical load systems cope with forces placed upon a structure by gravity while lateral load systems manage forces placed upon the structure by other forces such as high winds, floods, and seismic activity. Vertical load systems may include load-bearing walls and/or columns. Lateral load systems may include cross-braces, shear walls, and moment-resisting frames. Diaphragms are part of the horizontal structure of the building. The horizontal structure may include the floors of a building and its roof. The diaphragms may translate both vertical and lateral loads to the vertical and lateral load systems of the building. For example, the building's diaphragms may be coupled directly to the lateral load system to translate lateral loads. If loads are not properly translated from the diaphragm, the diaphragm may fail, and the structural integrity of the building may be compromised. In accordance with embodiments of the present disclosure, a diaphragm of a building constructed, at least in part, using pre-assembled components is arranged to effectively transfer loads into the lateral load system of the building while reducing the amount of fireproofing materials (e.g., intumescent paint) that may otherwise be required to fire-proof the building to code.

In the case of an external frame, the columns 212 (e.g., columns 212-1, 212-2, 212-3, and 212-4) may be arranged around the perimeter of the building. The beams 114 may connect adjacent columns and the columns and beams 212, 214, respectively, of the structural frame 210 may define, when viewed in plan as shown in FIGS. 2A and 2B, a generally rectangular space therebetween. A diaphragm 220 may be arranged within the rectangular space and coupled to the external frame. For example, the diaphragm 220 may be attached (e.g., mechanically fastened with bolts or welded) to any combination of the beams and/or columns of the frame 210 to transfer loads thereto.

In the illustrated example in FIG. 2A, the frame 210 includes four end columns (e.g., 212-1*a*, 212-1*b*) located at each of the four corners of the building, and pairs of intermediate columns (e.g., 212-2*a* and 212-2*b*), in this case three pairs of intermediate columns arranged opposite one another between the end columns. A beam extends between and peripherally joins each two adjacent columns to form, at least in part, the external frame 210 of the example in FIG. 2A. For example, beam 214-1*a* is arranged at one end of the building and joins the pair of adjacent end columns 212-1*a* 212-1*b* and similarly another beam is arranged at the opposite end joining the other pair of adjacent end columns. Perpendicularly arranged beams (e.g., beam 214-2*a*, 214-2*b*) extend between and join each end column to an intermediate column or two adjacent intermediate columns to one another. Thus, in this illustrated example, the floor system may include four sections, each of which may be associated with a single unit or in some cases a single unit may span multiple such sections. One of the four sections of this example is shown in an enlarged view in FIG. 2B and the diaphragm portion (e.g., diaphragm 220-1) associated therewith is described in more detail below with further reference to FIG. 2B. In other examples, different number or combinations of columns and beams may be used for the external structural frame 210. For example, its simplest arrangement, such as for a smaller footprint building, the external frame 210 may include only the four end columns without any intermediate columns, and the diaphragm may be formed using a single or a plurality of floor panels each connected at its opposite ends to a single pair of diaphragm beams that are in turn connected to the external frame, e.g., as in the partial view shown in FIG. 2B. Regardless of the size, number and/or specific arrangement of components, the principles of the diaphragm and the load path described herein may be preserved.

Referring now further to FIG. 2B, the diaphragm 220-1 may be constructed using one or more pre-assembled floor-ceiling panels 222. The individual pre-assembled floor-ceiling panels 222 may be generally rectangular in shape and have a pair of opposite longitudinal edges 252-1 and 252-2 extending along the longitudinal direction 250, and a pair of opposite transverse edges 262-1 and 262-2 extending along the transverse direction 260 of the panel 222. As will be further described (e.g., with reference to FIG. 3), each panel 222 may be pre-assembled (prior to delivery to the building site) to include a plurality of joist in a spaced arrangement between the opposite longitudinal edges. The joists may extend along the longitudinal direction (i.e., span the length of the panel). To construct the diaphragm, in examples where multiple floor-ceiling panels 222 are used, the panels 222 may be arranged side by side, e.g., with longitudinal edges adjacent to one another, and joined along their longitudinal edges, for example using first mounting components (e.g., one or more brackets which may be fastened or welded to one another).

The panels 222 may be supported by diaphragm beams 230 along their transverse edges. In some embodiments, the panels 222 may be supported only along their transverse edges. In some examples, each panel may include one or more second mounting components (e.g., one or more angle or L-shaped brackets) which may be rested against and joined (e.g., mechanically fastened, welded or otherwise joined) to a diaphragm beam 230. For example, the lateral edges 262-1 of the panels 222 may be joined to diaphragm beam 230-1 and the opposite lateral edges 262-2 of the panels 222 may be joined to another diaphragm beam 230-2. The diaphragm beam 230-1 may be arranged near and extend between end columns 212-1*a* and 212-1*b*. The diaphragm beam 230-2 may be arranged to extend between columns 212-2*a* and 212-2*b*. The diaphragm beams 230 may be joined to the external frame and may thereby transfer load from the diaphragm to the frame. For example, opposite ends of the diaphragm beam 230-1 may be joined to each of the pair of frame beams 212-2*a* and 214-22*b*. In other embodiments, the diaphragm beam 230-1 may be joined to directly to the columns or another component of the external frame. In some embodiments, the diaphragm beam 230-1 may be adjacent to (e.g., parallel to) a frame beam 214-1*a* that connects the end columns 212-1*a* and 212-1*b*. While the diaphragm beam 230-1 may be fire-rated, the frame beam 214-1*a* may or may not be fire-rated. The term fire-rated in the context herein is generally used to imply that the component is configured to meet the relevant fire code. In some examples, both of the adjacent beams (e.g., the diaphragm beam 230-1 and the frame beam 214-1) may be configured such that they meet the fire code. In some embodiments, the diaphragm beams (e.g., beams 230-1, 230-2) may be filled with a mineral based material such as concrete (for example, see beam 230-2 in FIGS. 7A and 7B), which may enable the beams (e.g., beams 230-1, 230-2) to meet fire code. In other embodiments, the beams may be fire-rated using different means, for example using conventional techniques such as via intumescent coatings, sprayed on mineral-based materials, insulative blankets, or others. In some embodiments, the diaphragm beam 230-2 supporting the opposite transverse edges of the floor-ceiling panels may be joined directly to the columns 212-2*a* and 212-22*b* (e.g., as shown in FIG. 2B), or it may be joined to a beam or other component of the structural frame.

The diaphragm may not be joined to a load bearing member along its longitudinal edges 221-1 and 221-2. Rather all loads from the diaphragm may be transferred to the external frame via the diaphragm beams 230, e.g., via the coupling assemblies 240 between the diaphragm beams 230 and the external frame 210, for example by following the load path diagrammatically illustrated by arrows A-C. As shown, load may be transferred along the diaphragm towards the transverse edges 262-1, 262-2 of the panels 222 as shown by arrows A. The load may be transferred to the diaphragm beams 230 (e.g., by the joints between the floor-ceiling panels and the diaphragm beams) and may then be transmitted along the diaphragm beams 230 toward the external frame 210 as shown by arrows B. The load may be transmitted from the diaphragm 220 to the external frame 210 via the coupling assemblies 240 between the diaphragm beams 230 and the external frame 210. For example, load may be transmitted to the beams (e.g., beams 214-2*a* and 214-2*b*) and then the columns (e.g., columns 212-1*a* and 212-1*b*), as shown by arrows C, or directly to a column (e.g., columns 212-2*a*, 212-2*b*) of the external frame 210, which then transfer the load to the foundation.

As illustrated, the panels 222 that form part of the diaphragm are not directly joined to the structural frame along at least one longitudinal edge (also referred to as unsupported longitudinal edge) and thus no load is transferred to the structural frame trough the interface of any other building components arranged along the unsupported longitudinal edge. Rather structural loads are transmitted from the panels to the diaphragm beams (e.g., via the internal structure of each panel such as the joists) and then the load is transmitted to the external frame via the coupling assemblies 240. In this regard, the panels 222 may be said to be unsupported along at least one of their longitudinal edges. In some embodiments, non-loadbearing walls may be joined to the floor-ceiling planes 222 along the longitudinal unsupported edges, such as a window wall or a utility wall. In some embodiments, one or more of the non-load bearing walls (e.g., end wall 108, window walls, utility walls) may be continuous walls that span the full distance between two columns of the external frame. For example, in the illustrated embodiment in FIG. 2B, the diaphragm 220-1 includes a first floor-ceiling panel 222-1 which has a first longitudinal edge 252-1 configured to support a window wall of the building and a second longitudinal edge 252-2 coupled to an adjacent middle panel 222-2. The first longitudinal edge 252-1 of the panel 222-1 also defines a first unsupported diaphragm edge 221-1 of diaphragm 220-1. The middle panel 222-2 is coupled on opposite sides (e.g., along both longitudinal edges) to other floor-ceiling panels. A third floor-ceiling panel 222-3, which defines the diaphragm's second unsupported diaphragm edge 221-2, is configured to be coupled to another non-loadbearing (e.g., a utility wall). In accordance with the examples herein, the amount of structural steel and thus fire-proofing of structural steel may be reduced by eliminating structural steel along the longitudinal edges of the panels.

Figure 3:
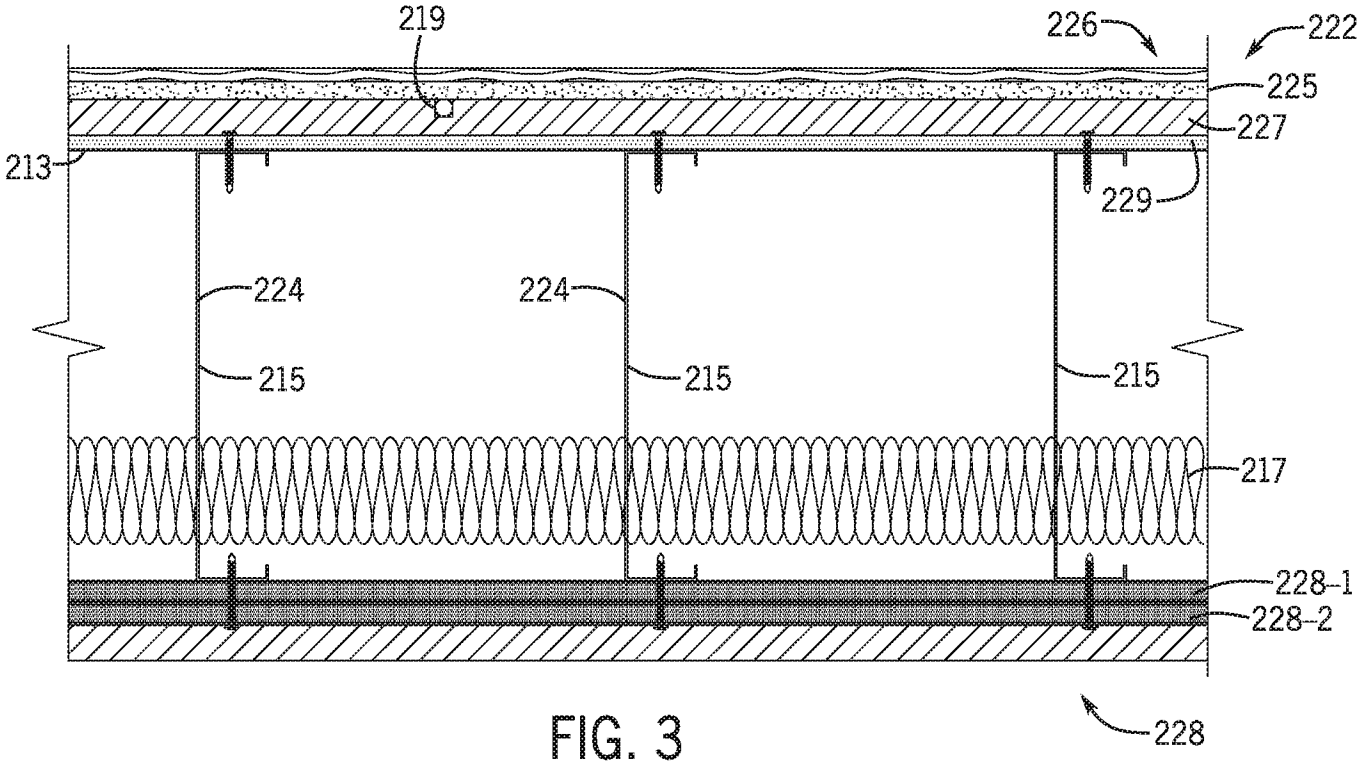
FIG. 3 is a partial cross-sectional view of one of the pre-assembled floor-ceiling panels in FIG. 2A taken along line 3-3.

FIG. 3 shows a partial cross section of a pre-assembled floor panel 222 in accordance with some embodiments of the present disclosure. The various components and arrangement thereof shown in FIG. 3 are merely illustrative, and other variations, including eliminating components, combining components, and substituting components, or rearranging components are all contemplated. The floor-ceiling panel 222 may have a generally box shaped construction, which may be designed to distribute and carry loads towards the transverse edges of the panel. The panel 222 may be pre-assembled to include a floor-panel frame 224, which includes a plurality of joists 215 in a spaced laterally and extending along the longitudinal direction of each panel. An upper or floor panel 226 and a lower or ceiling panel 228, respectively, may be joined to opposite sides of the frame. Insulation 217 may be provided within the cavity defined between the upper and lower panels 226, 228, respectively. The pre-assembled floor-ceiling panels 222 may be configured to carry diaphragm loads to the structural frame without the use of a concrete slab, as is typically done in conventional construction.

The individual layers of the floor panel 226 and the ceiling panel 228 may be formed using discrete (e.g., separable) pre-manufactured construction elements (e.g., boards of non-combustible materials, such as cement board, magnesium oxide (MgO) board, fiber-cement board, gypsum board, fiberglass-clad cement or gypsum board, metal-clad cement or MgO board, and other suitable mineral-based materials), which may be joined to the floor-panel frame 224 off-site (e.g., in a factory or other location remote) prior to delivery of the floor-ceiling panels 222 to the building site, thus reducing on-site construction time/costs. The floor panel 226 may include at least one layer 225 made substantially from non-combustible material (e.g., cement board, magnesium oxide (MgO) board, etc.) and at least one metal diaphragm layer (e.g., a sheet of steel such as a 22 gage steel sheet or another). The metal diaphragm layer 229 may be attached to (e.g., bonded or mechanically fastened) the non-combustible material and/or to the floor-panel frame 224. In some embodiments, the metal diaphragm layer may be simply sandwiched between layers of the floor panel 226 and/or the floor-panel frame 224 (e.g., between a layer of non-combustible material and the frame or between two layers of non-combustible material) without being otherwise attached thereto. In some embodiments, the floor panel 226 may include a radiant heating element 219, which may be provided in a layer (e.g., foam or other type of insulative layer 227) of the floor panel 226. The ceiling panel 228 may include at least one layer (e.g., layers 228-1, 228-2) made substantially from non-combustible material (e.g., cement board, magnesium oxide (MgO) board, fiber-cement board, gypsum board, fiberglass-clad cement or gypsum board, metal-clad cement or MgO board, and other suitable mineral-based materials).

In some embodiments, the panel frame 224 (e.g., joists 215) may be formed of metal, such as aluminum or steel. In some embodiments, the panel frame 224 may be formed of a non-metallic material, such as wood, plastic, or composite materials such as fiber reinforced composites. In the illustrated example, the joists 215 are implemented using metal C-channels, e.g., of lightweight steel as manufactured by Steelform Building Products Inc. (marketed under the name Mega Joist). A variety of other types of joists, for example and without limitation I-shaped, or closed, box shaped joists may be used in other embodiments. The insulation 217 provided in the panel 222 may include thermal and/or sound insulation. For example, sound dampening materials (e.g., sound strips) may be provided between the individual layers of the floor panel 226 and the ceiling panel 228 and/or between these panels and the frame (e.g., between the panels and the joist).

The floor-ceiling panels 222 may define a generally enclosed space by the floor-panel frame 224 and the floor and ceiling panels 226, 228, respectively. Mounting components (e.g., angles, angle clips, L-shaped or C-shaped brackets, or brackets of other types or geometries) may be joined to the floor-panel frame 224 along the longitudinal and transverse edges of the panel 222 for joining each panel to an adjacent panel and/or to a diaphragm beam.

Figure 4:
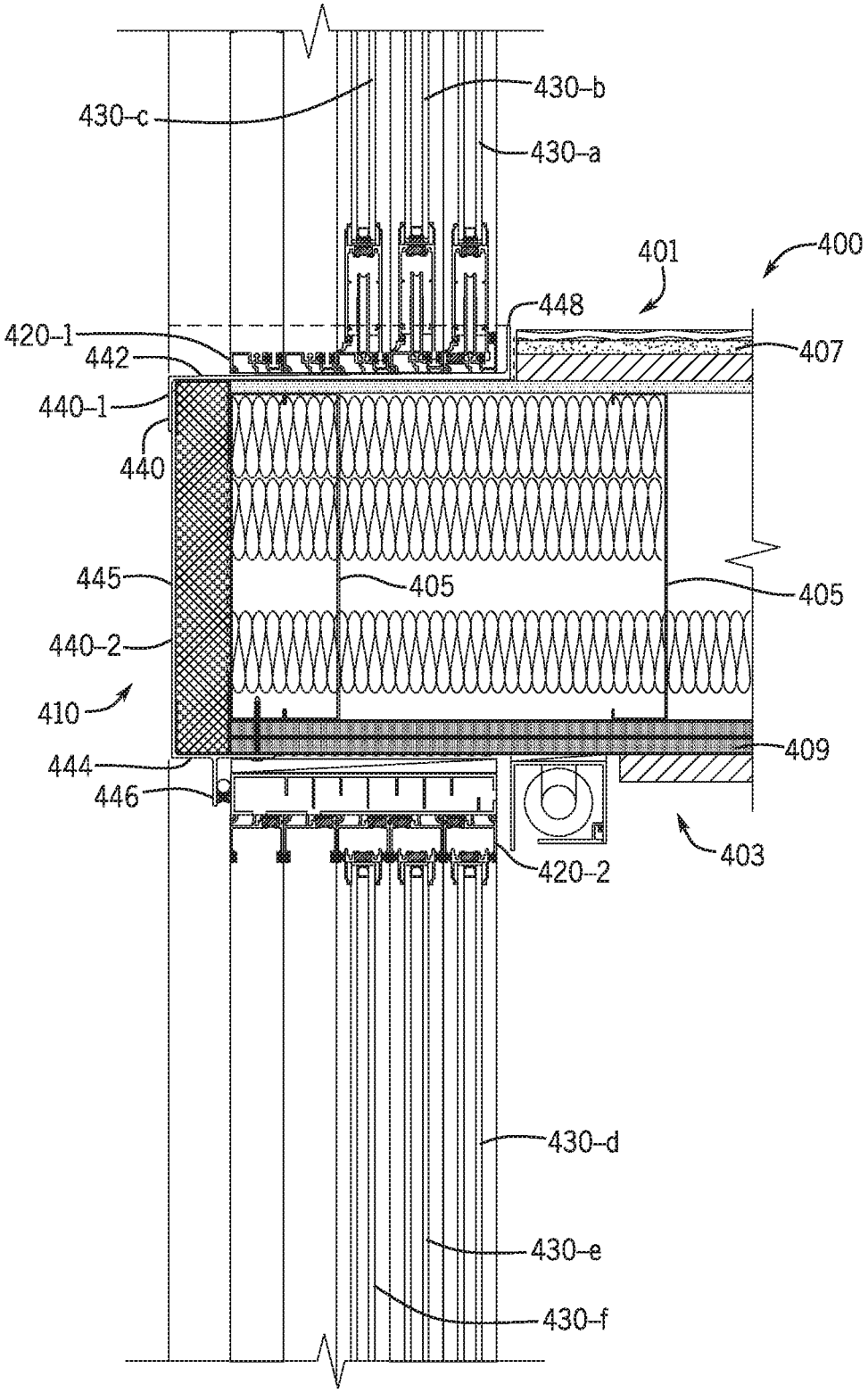
FIG. 4 is a partial cross-sectional view of a pre-assembled floor-ceiling panel and window panels associated with upper and lower stories of a building.

In some embodiments, at least one floor-ceiling panel of the plurality of floor-ceiling panels that form the diaphragm may be pre-assembled to include a track configured to receive one or more window panels. For example, FIG. 4 shows a portion of a floor-ceiling panel 400 which include a track 410 in accordance with at least some embodiments of the present disclosure. The various components and arrangement thereof shown in FIG. 4 are merely illustrative, and other variations, including eliminating components, combining components, and substituting components, or rearranging components are all contemplated.

The portion of panel 400 shown in FIG. 4 may be part of one or more panels of a diaphragm (e.g., diaphragm 220) according to the present disclosure. FIG. 4 shows a cross-sectional partial view of a longitudinal edge of floor-ceiling panel 400, showing a portion of the floor side 401 of the floor-ceiling panel 400 and a ceiling side 403 of the floor-ceiling panel 400. For example, the view in FIG. 4 may be representative of the longitudinal edge 252-1 of floor-ceiling panel 222-1 in FIG. 2B). As described, the floor-ceiling panel 400 may include a floor panel 407 and a ceiling panel 409 joined to opposite sides of a plurality of joists 405.

The panel 400 may include a first track 420-1 extending along a longitudinal edge 410 of the panel 400. The track 420-1 may be configured to receive at least one floor-to-ceiling-window panel 430. The first track 420-1 may be attached to the floor side 401 of the first floor-ceiling panel 400. The panel 400 may include a second track 420-2 attached to the ceiling side 403 of the floor-ceiling panel 400 and extending along the longitudinal edge 410 of the panel 400. The second track 420-2 may be similarly configured to receive at least one floor-to-ceiling-window panel 430. As will be understood, the first track 420-1 may receive the lower proton(s) of at least one floor-to-ceiling-window panel (e.g., bottom portions of floor-to-ceiling-window panels 430-*a*, 430-*b*, and 430-*c*), while the second track 420-2 may receive the upper proton(s) of at least one floor-to-ceiling-window panel (e.g., upper portions of floor-to-ceiling-window panels 430-*d*, 430-*e*, and 430-*f*). The floor-to-ceiling-window panel(s) may thus define a window wall of a unit, such as unit 105 of the building 101 in FIG. 1. In other embodiments, a different number (other than 3) may be used for the window walls on the various levels of the building. In some embodiments, the tracks 420-1 and 420-2 may be configured to slidably receive the respective window panels; that is, the respective window panel may be slidable along the respective track. The longitudinal edge 410 of panel 400 may be unsupported by the external frame of the building. As illustrated and described, the longitudinal edge 410 of panel 400 may not be directly coupled to a load-bearing element. Instead, loads may be transmitted along the length of the floor-ceiling panel 400 towards the diaphragm beams and the external frame.

In some embodiments, at least one floor-ceiling panel of the plurality of floor-ceiling panels that form the diaphragm may be pre-assembled to include a water impermeable member enclosing a longitudinal edge of the panel. For example, as shown in FIG. 4, floor-ceiling panel 400 may include a water impermeable member 440 disposed along the longitudinal edge 410. The water impermeable member 440 may be implemented using a plastic or composite (e.g., a fiber-reinforced plastic (FRP)) C-channel which encloses at least part of the upper or floor side, part of the lower or ceiling side, and the edge side of the panel 400. The water impermeable member 440 may be formed using a variety of techniques such extrusion, pultrusion, casting, molding, machining or the like, to form a continuous elongate member that can span substantially the full length of the longitudinal edge 410 of panel 400. Once the continuous elongate member is formed it may be attached (e.g., bonded or otherwise fastened in a manner to retain the water impermeability of the assembly) to the panel 400 in the factory, before the panel 400 is delivered to the building site.

The water impermeable member 440 may include an upper flange 442, a lower flange 444, and a web 445 connecting the upper and lower flanges 442 and 444, respectively. The upper flange 442 may extend fully under the first track 420-1, which may reduce or minimize the risk of water intrusion and thus facilitate sealing the building envelope (e.g., once the window panels are installed). In some embodiments, the upper flange 442 may include a lip 448 protruding from the flange 442. The lip 448 may adjacent to, in some cases abutting, an interior side of the track 420-1, which may provide a more robust and water-resistant assembly.

The lower flange 444 may extend at least partially, or in some cases fully, under the second track 420-2, which may again serve to reduce or minimize the risk of water intrusion. The lower flange 444 may include a ledge 446 which may be adjacent to an outer side of the track 420-2. The ledge 446 may protrude downward from the flange 444. By providing a ledge 446 on the exterior side of the track 420-2, the gap between the track 420-2 and the ceiling side 403 of panel 400 may be better sealed against water intrusion. In some embodiments, the lower flange 444 may additionally or alternatively include a lip protruding downward and arranged on the interior side of track 420 similar to the arrangement on the floor side. In some embodiments, the water impermeable member 440 may be a single continuous member wrapping around the longitudinal edge 410 of the panel 400, that is covering at least a portion of the floor side 401, a portion of the ceiling side 403 and the edge side of the longitudinal edge 410 of the panel 400. In other embodiment, for example as shown in FIG. 4, the water impermeable member 440 may be formed using two or more elongate shaped members, such as a lower member 440-2, which includes the lower flange 444 and a vertical portion, and an upper member 440-1, which includes the upper flange 442 and another vertical portion, which preferably overlaps an edge of the vertical portion of the lower member 440-20 for better waterproofing.

Referring back to FIGS. 2A and 2B, in some embodiments, a first one of a pair of diaphragm beams (e.g., diaphragm beam 230-1) supporting a floor panel 222 may be coupled to beams (e.g., beams 214-1*a* and 214-1*b*) of the external structural frame 210 while a second one of the pair of diaphragm beams (e.g., diaphragm beam 230-2) supporting the same floor panel 222 may be coupled directly to respective columns (e.g., column 212-2*a* and 212-2*b*) of the structural frame 210. FIGS. 5 and 6 illustrate portions of a diaphragm and coupling assemblies for joining the diaphragm to the external frame in accordance with some examples of the present disclosure.

Figure 5A:
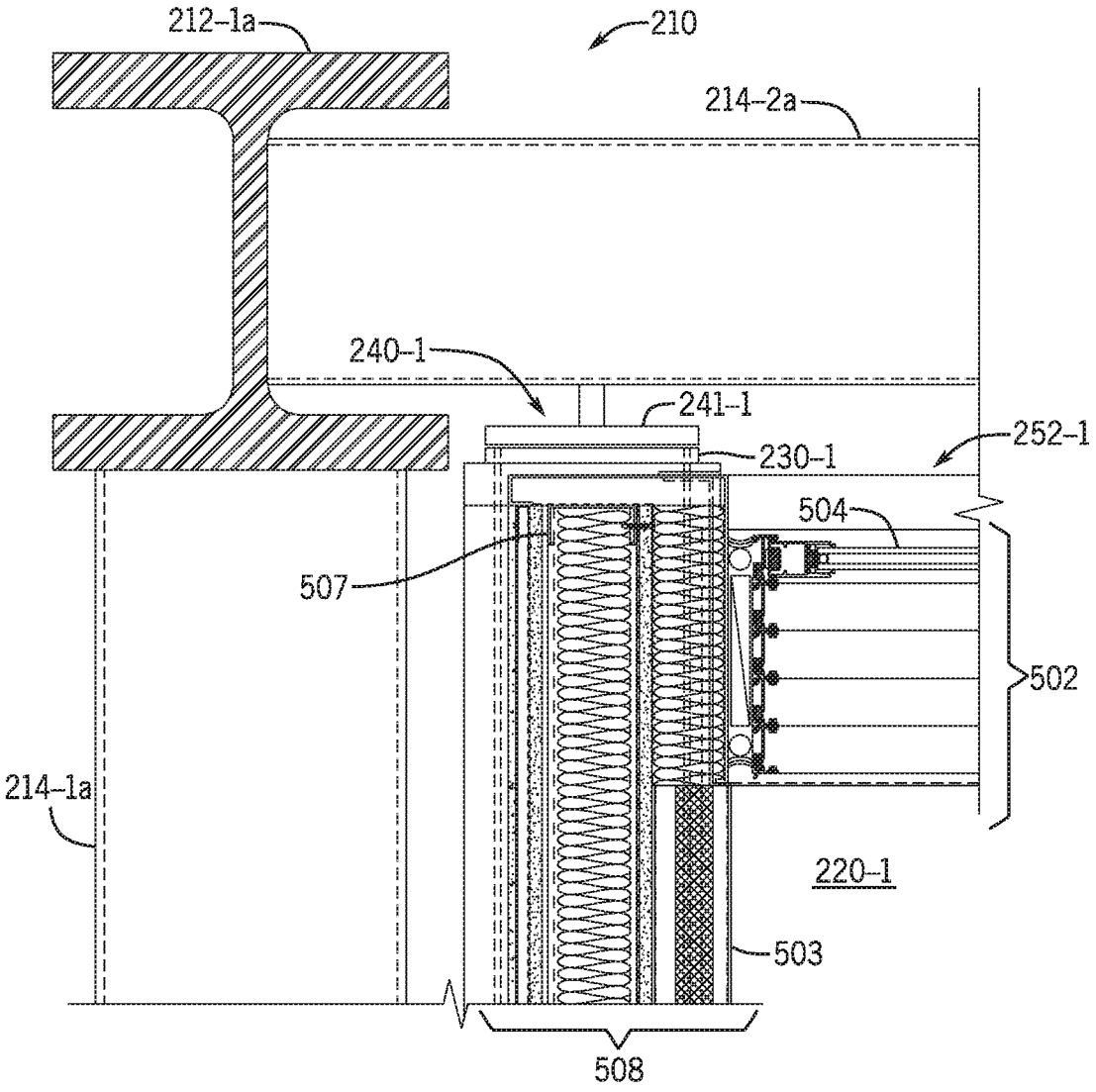
FIGS. 5A, 5B and 5C are partial cross-sectional views showing portions of a diaphragm and coupling assemblies for attaching the diaphragm in FIG. 2B to an external structural frame.
Figure 5B:
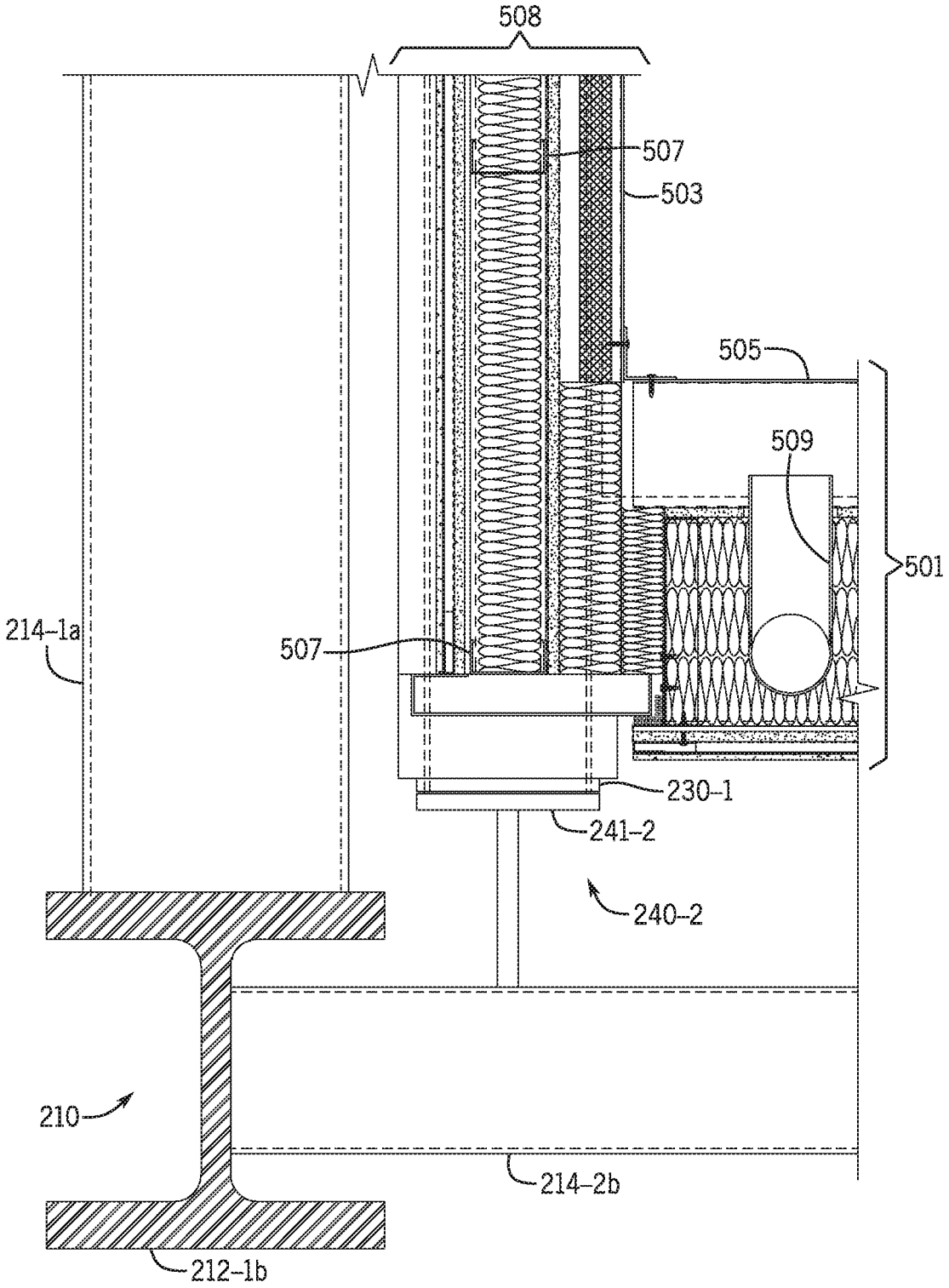
Figure 5C:
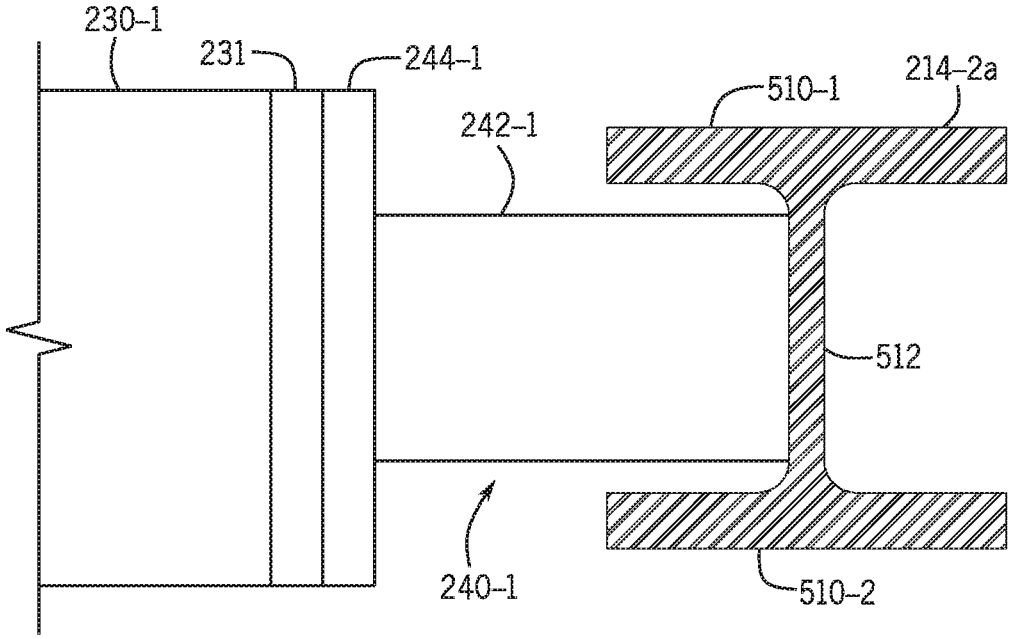

Specifically, FIGS. 5A and 5B show the coupling assemblies between the external frame 210 and each of the two opposite ends of diaphragm beam 230-1 in FIG. 2B, as indicated by the arrows 5A and 5B in FIG. 2B. The various components and arrangement thereof shown in FIGS. 5A and 5B are merely illustrative, and other variations, including eliminating components, combining components, and substituting components, or rearranging components are all contemplated.

FIGS. 5A and 5B show respective end portions of the frame beam 214-1*a*, which connects the two end columns 212-1*a* and 212-1*b*. Additionally, illustrated are portions of the frame beams 214-2*a* and 214-2*b*, which are substantially perpendicular to beam 214-1*a*, and which are connected respectively to columns 212-1*a* (see FIG. 5A) and 212-1*b* (see FIG. 5B). The diaphragm beam 230-1 is arranged substantially parallel to the frame beam 214-1*a*. The diaphragm beam 230-1 is offset inwardly (that is, toward the interior of the building) from the frame beam 214-1*a*. That is, the frame beam 214-1*a* is arranged externally to and spaced from the diaphragm beam 230-1 and thus from the transverse edge of the diaphragm 220-1. Similarly, the longitudinal edges of the diaphragm 220-1, which are defined by longitudinal edges of the outermost floor-ceiling panels are offset inwardly from and are thus unsupported by the frame beams 214-2*a* and 214-2*b*. That is the frame beams 214-2*a* and 214-2*b* are arranged externally to and spaced from the longitudinal edges of the outermost floor-ceiling panels and thus the diaphragm 220-1. As such, any load that is transferred from the diaphragm to the external frame 210 via the load path provided by diaphragm beam 230-1 is transferred thereto only via the coupling assemblies 240-1 and 240-2. Similarly, at the other transverse edge of the diaphragm and as will be described further with reference to FIGS. 6-7, any load that is transferred from the diaphragm to the external frame 210 via the load path provided by the other diaphragm beam 230-2 of the diaphragm 220-1 is transferred thereto only via the coupling assemblies between diaphragm beam 230-2 and the respective column.

Each of the frame beams 241-2*a* and 241-2*b* may be implemented using an I-beam for example (see also FIG. 5C), with the flanges 510-1 and 510-2 of the I-beam oriented horizontally and the web 512 oriented vertically. A coupling assembly according to some embodiments may be implemented using a connector bracket 241-1 having a generally T-shaped cross section. The base or leg portion 242-1 of the connector bracket 241-1 may extend generally perpendicularly from the web 512 of the frame beam (e.g., frame beam 241-2*a*) and the top or flange portion 244-1 of the connector bracket 241-1 may be perpendicular to the leg portion 242-1 and parallel to the web 512 of the frame beam (e.g., frame beam 214-2*a*). The base or leg portion 242-1 may be directly rigidly coupled, for example by welding or bolting it, to the respective frame beam (e.g., frame beam 241-2*a* in the example in FIGS. 5A and 5C, or to frame beam 241-2*b* as in the example in FIG. 5B) and the top or flange portion 244-1 of the connector bracket 241-1 may be rigidly coupled to the diaphragm beam (e.g., diaphragm beam 230-1) such as by welding or mechanically fastening the top portion 244-1 to an end cap 231 of the diaphragm beam. A similar connector bracket 241-2 may be used at the other end of diaphragm beam 230-1, such as to connect the other end of diaphragm beam 230-1 to the opposite frame beam 241-2*b*.

The leg portion 242-1 may be implemented using a metal plate (e.g., structural steel or other) and may have a height selected to fit between the flanges 510-1 and 510-2 of the I-beam. In some embodiments, the leg portion may have one or more base flanges, for example to allow the leg portion to be bolted to the web 512. In other embodiments, the leg portion may not include base flanges, such as when welding the connector bracket to the web 512. The connector bracket 241-1 may additionally or alternatively be coupled (e.g., welded) to the flanged 510-1 and 510-2. The top or flange portion 244-1 of the connector bracket 241-1 may be implemented also using a metal plate (e.g., structural steel or other) and its length (in the vertical direction, when installed) may be greater, in some embodiments, than the distance between the flanges 510-1 and 510-2 of the I-beam. The flange portion 244-1 may be configured to be substantially coextensive with the end cap 231 of the diaphragm beam 230-1, which may enable better load transfer from the diaphragm to the frame. The base or leg portion 242-1 may but need not be centered on the top portion 244-1. In some cases, it may be advantageous for the top portion 244-1 to be off center depending on the desired vertical location of the diaphragm beam 230 in relation to the frame beam 214-2*a*. Also, typically, the brackets 241-1, 241-2 may be formed as integral, monolithic parts (e.g., the leg portion 242-1 and flange portion 244-1 are integrally formed by casting, machining, or other suitable technique); however, it is envisioned that the two parts may alternatively be separately formed and rigidly joined (e.g., welded).

FIGS. 5A and 5B also show, in cross section, portions of the walls that are supported by the diaphragm 220-1. Specifically, FIG. 5A shows a portion of an end wall 508 and a portion of a window wall 502, defined by at least one floor-to-ceiling window panel 504. The end wall 508 is erected vertically from the diaphragm 220-1 and extends along the transverse edge of the diaphragm 220-1. The end wall 508 may be a pre-fabricated wall which includes, as delivered to the building site, all internal components (e.g., conduits, insulation, studs 507, etc.) to provide thermal and sound insulation as well as supply electrical power to a unit and/or support other subsystems of the building (e.g., HVAC, fire suppression, etc.). In some examples, the pre-fabricated end wall 508 may be delivered to the building site with the interior finish material 503 and/or exterior cladding materials attached thereto. In some embodiments, at least a portion of these layers (e.g., the interior finish material) may be temporarily removed in the field, for example to facilitate installation of the end wall to the floor system, following which the removed layer may be re-attached. In some embodiments, at least some of the layers these layers (e.g., the exterior cladding material and/or at least some portions of the interior finish material) may not be intended to be removed from the wall once it leaves the factory. In some embodiments, a single pre-fabricated end wall 508 may extend the full length of the transverse edge of the diaphragm 220-1.

The window wall 502 may extend along the longitudinal unsupported edge of the diaphragm 220-1. In some examples, a plurality of separable floor-to-ceiling window panels 504 may be used to define a full window wall, e.g., a wall that spans the full length of the longitudinal edge of the diaphragm 220-1. In some cases, the individual floor-to-ceiling window panels 504 may be coupled to the diaphragm such that they are slidable along the longitudinal edge thereof. As described, the floor-ceiling panels may be delivered to the building site with a window track already pre-installed. Similarly, walls adjacent to the floor-ceiling panel that includes a window track may similarly be delivered to the building site with a wall-side track pre-installed thereon, such that field installation of the window wall mostly involves the coupling of the individual window panels 504 to the respective tracks. This may further enhance efficiency as the steps of glazing or caulking that are typically part of conventional construction (e.g., in steel-glass buildings) are substantially obviated.

FIG. 5B shows another portion of the end wall 508 and a portion of a utility wall 501 coupled to one another and the diaphragm 220-1. The utility wall 501 may be implemented using a pre-fabricated wall which includes, as delivered to the building site, substantially all internal components such as insulation, plumbing conduits (e.g., pipe 509) for providing plumbing to a unit, and/or any other components needed to support other sub-systems (e.g., electrical, HVAC, fire suppression, etc.) of the building. In some examples, the pre-fabricated utility wall 501 may be delivered to the building site with the interior finish material 505 (e.g., tile, or other) and/or exterior cladding materials attached thereto, some portions of which may be temporarily removed during installation of the utility wall to the floor system and re-attached thereafter. In some examples, the utility wall 501 may span the full length of the longitudinal edge of diaphragm 220-1 and may span more than one stories of the building. In some embodiments, the utility wall 501 may be implemented in accordance with any of the examples described in co-pending international patent application PCT/US17/21179, titled "A Pre-Assembled Wall Panel For Utility Installation," which application is incorporated herein by reference in its entirety for any purpose.

Figure 6A:
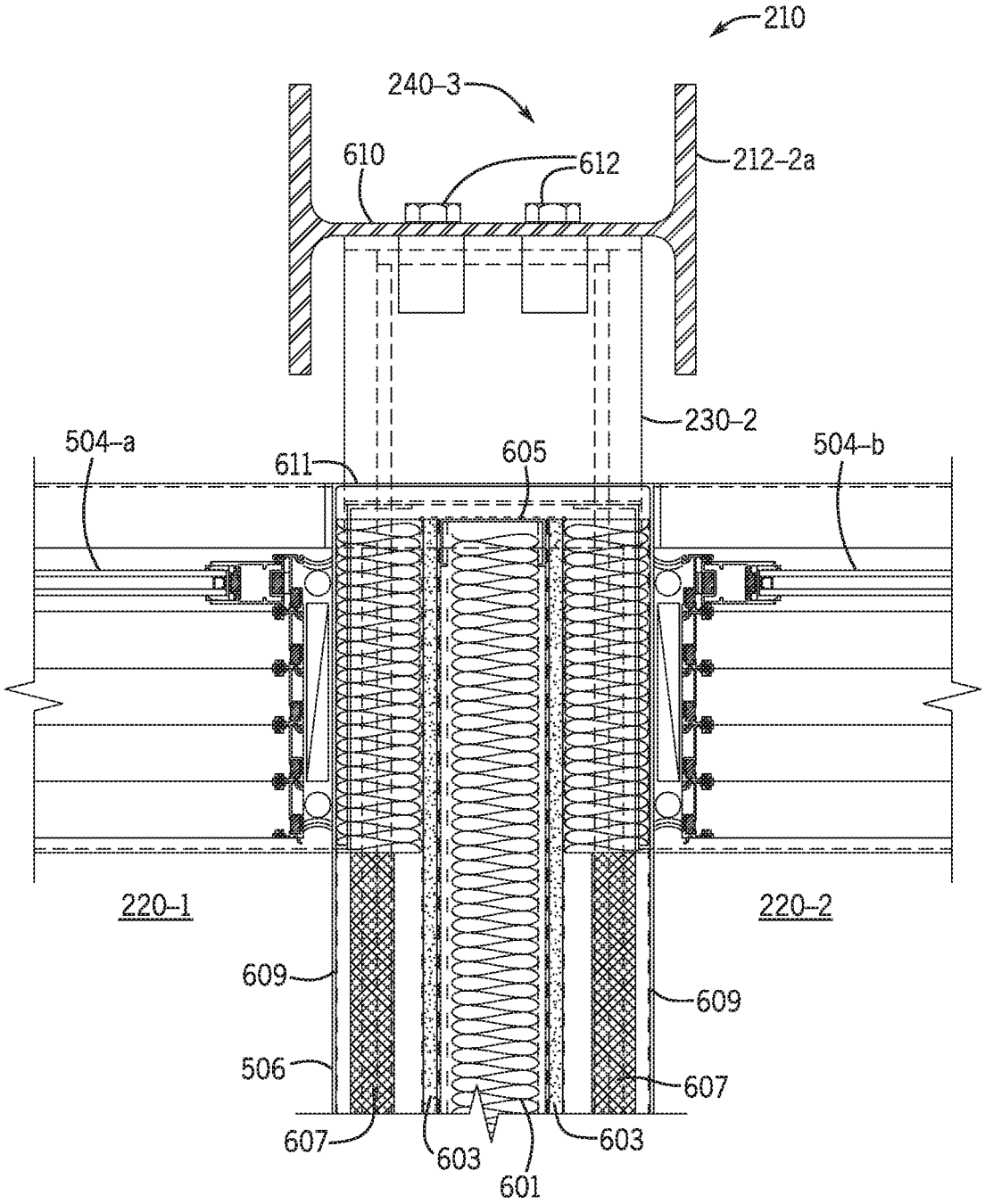
FIGS. 6A, 6B, 7A, and 7B are additional partial cross-sectional views showing other portions of the diaphragm in FIG. 2B and coupling assemblies for attaching the diaphragm to an external structural frame.
Figure 6B:
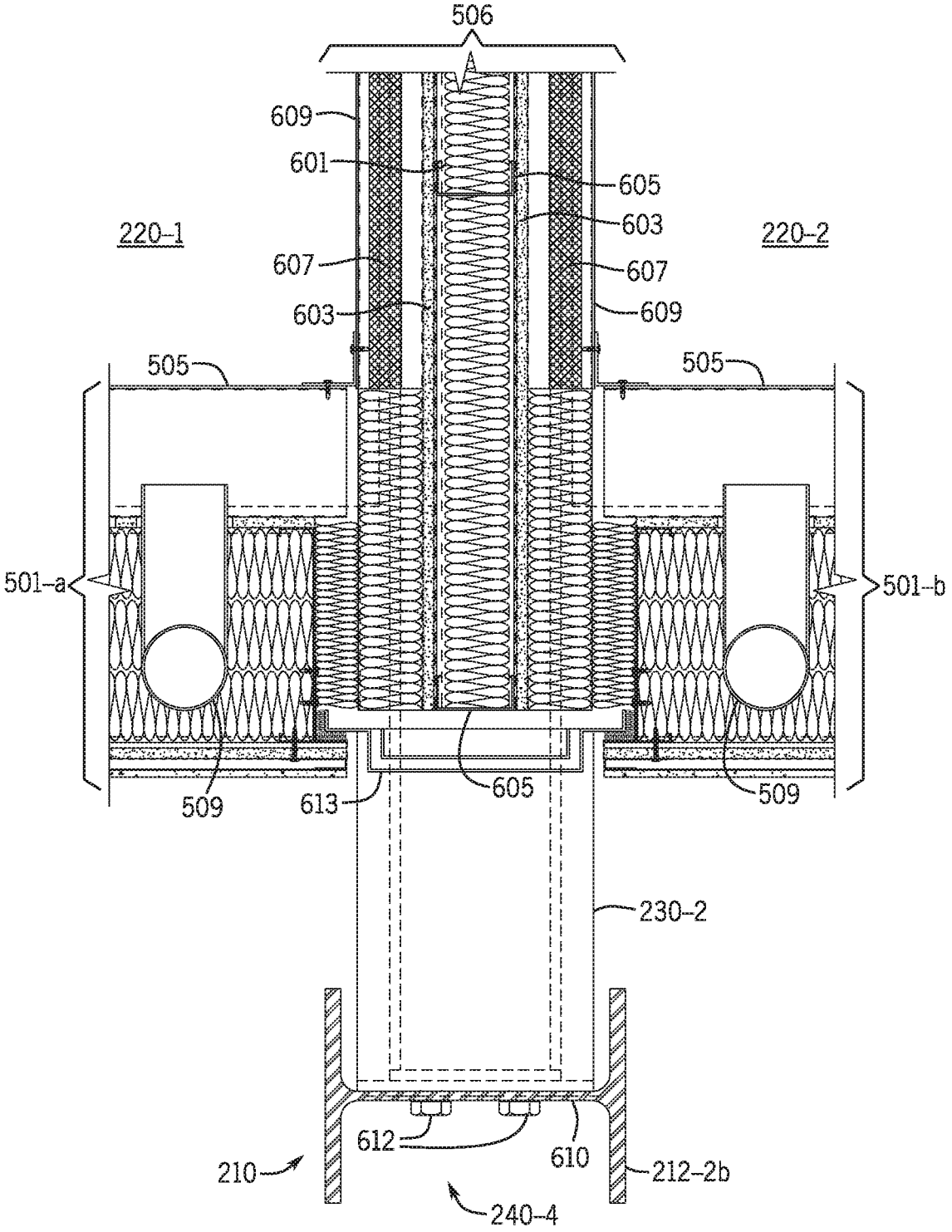
Figure 7A:
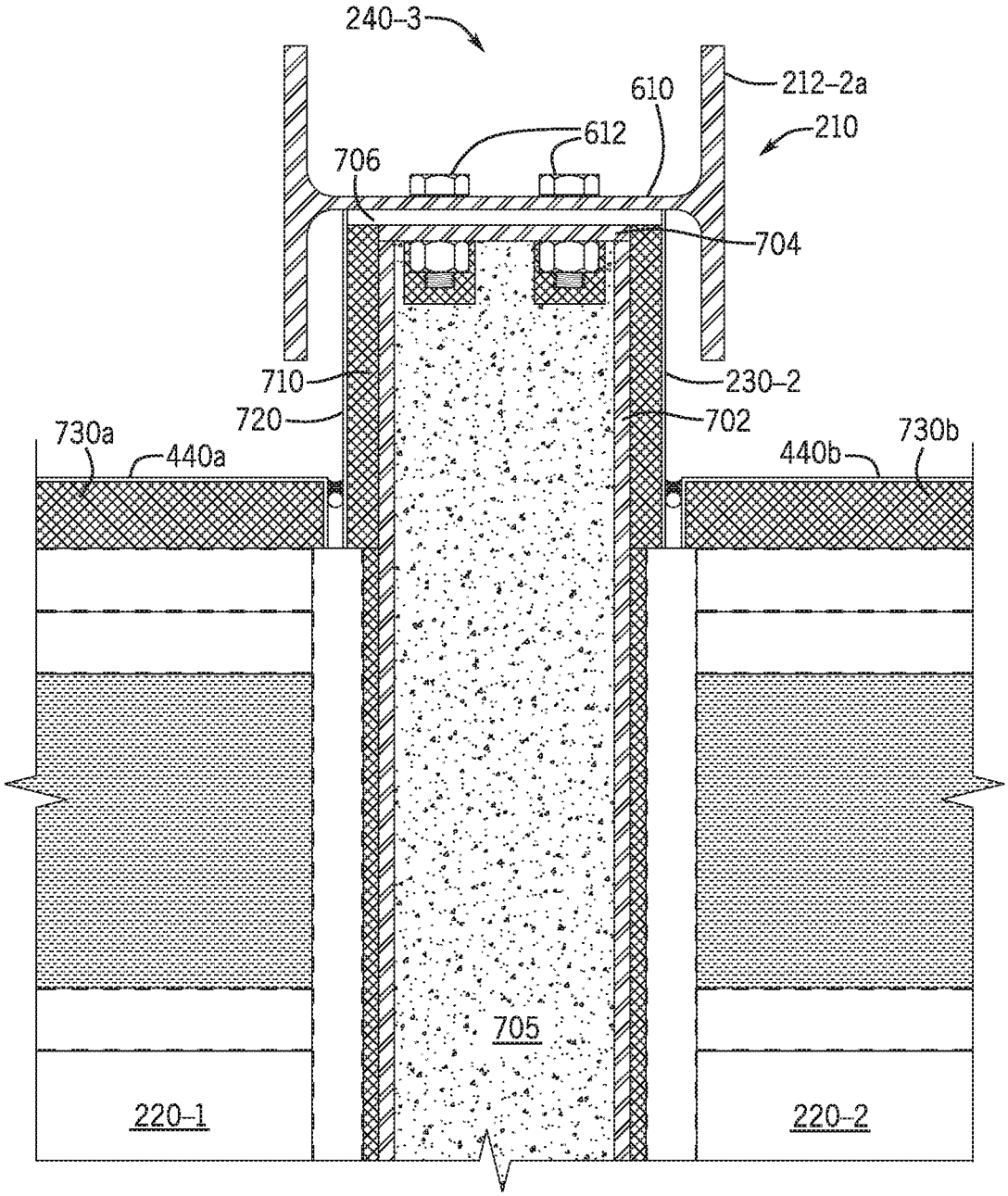
Figure 7B:
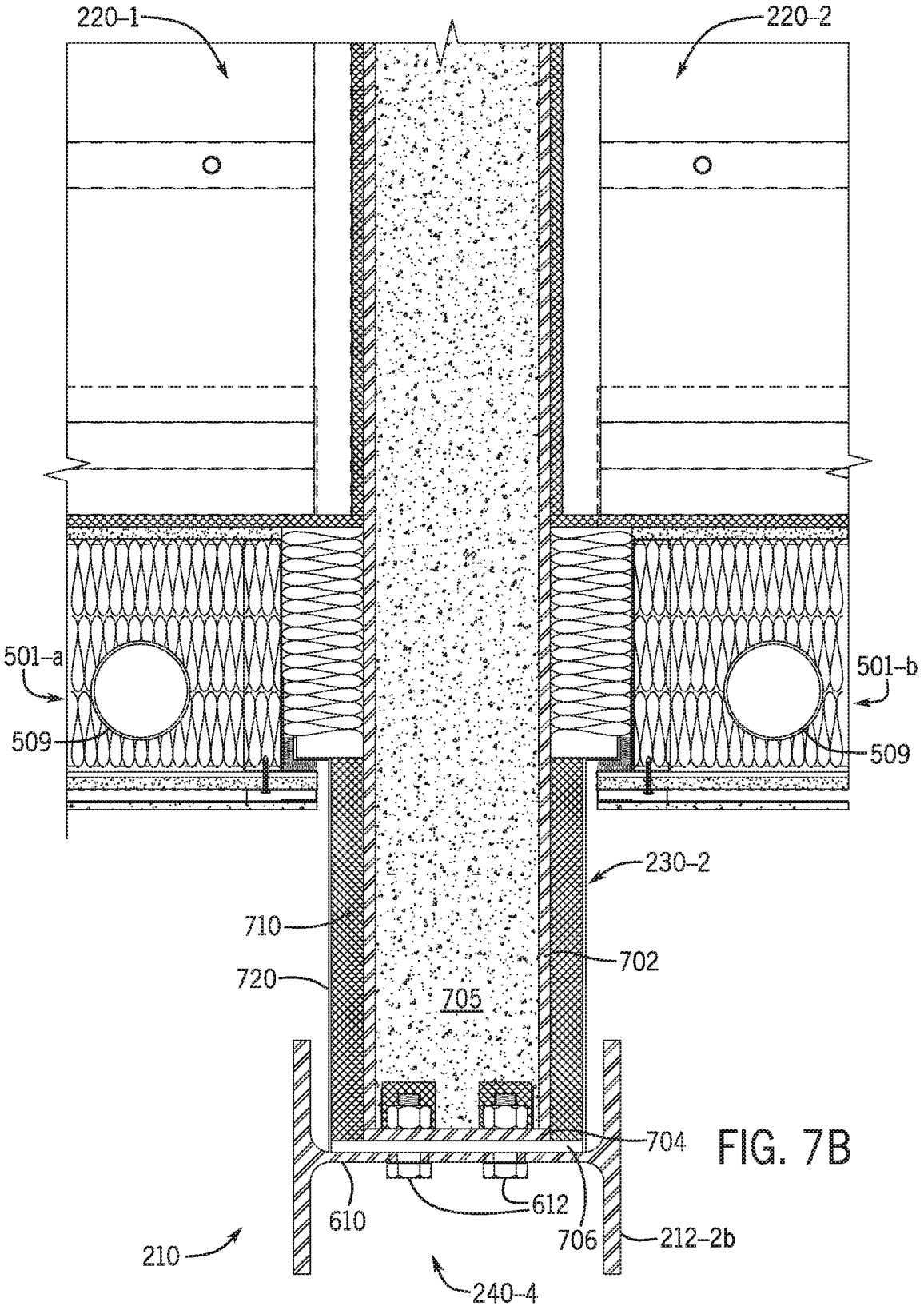

FIGS. 6A and 7A show the portion of the diaphragm 220-1 and associated coupling arrangement for coupling the diaphragm 220-1 to the intermediate column 212-2*a* as indicated by arrow 6A in FIG. 2B. FIGS. 6B and 7B show the portion of the diaphragm 220-1 opposite the one shown in FIGS. 6A and 6B, as indicated by arrow 6B in FIG. 2B. In FIG. 6, the cross-section is taken at a vertical location above floor level thus showing the walls in cross section, while in FIG. 7 the cross-section is taken at a vertical location below floor level thus showing the diaphragm beam 230-2 in cross section.

FIG. 6A shows part of the diaphragm portion 220-1 and part of another diaphragm portion 220-2 each of which is supported by the same diaphragm beam 230-2. The diaphragm portion 220-1 is provided by a first plurality of pre-assembled floor-ceiling panels arranged on one side of the diaphragm beam 230-2 and the diaphragm portion 220-1 is provided by a second plurality of pre-assembled floor-ceiling panels arranged on the opposite side of the diaphragm beam 230-2. In some embodiments, (e.g., as shown in FIG. 6A), at least one floor-ceiling panels of each of the first and second pluralities of pre-assembled floor-ceiling panels includes a track (e.g., as described with reference to FIG. 4), which is configured to support a window wall. As illustrated in FIG. 6A, the end floor-ceiling panel of diaphragm portion 220-1 includes a track which is configured to receive at least one floor-to-ceiling window panel (e.g., window panel 504-*a*). Similarly, the end floor-ceiling panel of the diaphragm portion 220-2 includes a track which is configured to receive at least one floor-to-ceiling window panel (e.g., window panel 504-*b*). The window panels 504-*a* and 504-*b* may, in some examples, be slidably coupled to the respective tracks.

The assembly shown in FIG. 6A also includes a pre-assembled interior wall (e.g., demising wall 506), which includes corresponding first and second tracks on opposite sides of the wall and which are configured to operatively engage one or more of the window panels of the respective window wall. Similar to other walls described herein, the demising wall 506 may be a pre-assembled interior wall for use in constructing a building (e.g., building 101 of FIG. 1). The demising wall 506 may thus include, as delivered to the building site, some or all internal components, such as conduits (e.g., for electrical, HVAC, and fire suppression sub-systems or others) and insulative materials 601 (e.g., thermal and/or sound insulation) as may be desired to support use of the associated units or rooms defined on both sides of the interior wall. The internal components (e.g., conduits, insulation, etc.) may be substantially or at least partially enclosed within a wall frame that includes wall studs 605, and thus may be sandwiched between layers 603 of mineral based material coupled to opposite sides of the wall frame. In some embodiments, additional insulation 607 may be placed externally to the layers 603 of mineral based material. In some embodiments, the demising wall 506 may include wall brackets extending from one or more of the layers 603 and which may support the additional insulation 607 in a spaced arrangement with respect to the layers 603.

In some embodiments, the demising wall 506 may be pre-assembled and delivered to the building site with the interior wall finish 609 material, some of which may be temporarily removed at the site, e.g., to facilitate installation of demising wall 506. In some embodiments, the demising wall 506 may be positioned directly over the diaphragm beam 230-2 and in some examples, may be fastened to the beam 230-2 and or the respective floor-ceiling panels. However, as described, the demising wall 506 may be coupled to the diaphragm 220 (e.g., diaphragm beam 230-2 and/or floor-ceiling panels) in a manner so as not to transmit or carry structural loads. That is, the coupling between the demising wall 506 and the diaphragm 220 may be generally for positioning and retaining be demising wall 506 in place rather than for providing a load path for structural loads (vertical and/or lateral loads experienced by the building). In some examples, the demising wall may be coupled to the diaphragm beam 230-2 and/or floor-ceiling panels using a non-rigid connection (e.g., using springs or movable components). Such non-rigid connection may allow the beam 230-2 and/or floor-ceiling panels to displace slightly relative to the wall 506, such as when carrying diaphragm loads, which may avoid any significant transference of loads to the non-load bearing wall 506. In some embodiments, the demising wall 506 may be implemented in accordance with any of the examples described in co-pending international patent application PCT/US17/21174, titled "Prefabricated Demising Wall with External Conduit Engagement Features," which application is incorporated herein by reference in its entirety for any purpose.

As further illustrated in FIG. 6A and also referring to FIGS. 6B, 7A and 7B, the diaphragm beam 230-2 may extend beyond the envelope of the building towards the column 212-2*a* for coupling the diaphragm thereto. As described, the diaphragm (e.g., diaphragm portions 220-1 and 220-2) may be coupled to the external frame 210 only via the coupling assemblies (e.g., 240-3 in FIGS. 6A and 7A, and 240-4 in FIGS. 6B and 7B) between the diaphragm beam 230-2 and the respective columns and thereby loads from the diaphragm may be transferred to the frame 210, at these locations, only via the coupling assemblies 240-3 and 240-4. The coupling assemblies for coupling a diaphragm beam to an intermediate column may be implemented by joining the end of the diaphragm beam 230-2 directly to the web 610 of the intermediate column (e.g., columns 212-2*a* and 212-*b*). Each end of the diaphragm beam 230-2 may be enclosed by a metal end cap or plate 704 and the beam may be bolted to the web 610 of the respective column via the fasteners 612. Other suitable techniques, such as welding, may be used to join the diaphragm beam 230-2 to the intermediate columns (e.g., column 212-2*a* and 212-2*b*).

Any of the diaphragm beams described herein may be implemented using a steel, closed-cross section member 702, e.g., a beam with a hollow structural section (HSS), which in some embodiments may be filled with a mineral-based material 705 (e.g., concrete) or other type of fire-resistant material. Filling the interior of the diaphragm beams with a mineral-based or other type of fire-resistant material may enable the beams to be fire-rated, e.g., to meet fire code, and thus obviate the need to use other types of fire resistant treatments (e.g., intumescent paint, spray on insulation, etc.), which may be more costly or more time consuming to install.

In some embodiments, the diaphragm beams, or a portion thereof may be additionally optionally thermally insulated, particularly at the envelope (e.g., at the joint with a highly thermally conductive metal column). In some embodiments, the coupling assembly associated with each diaphragm beam (e.g., coupling assemblies 240-3 and 240-4) may include a thermal break material 706, disposed between the diaphragm beam and the column (e.g., between end caps 704 of diaphragm beam 230-1 and the respective webs 610 or the respective columns 212-2*a* and 212-2*b*). The thermal break material may be a plastic or composite material or any suitable material having a lower thermal conductivity than the metallic materials used for the columns and beams (e.g., structural steel). In some embodiments, at least the end portions of the diaphragm beams (e.g., any exposed portion of the diaphragm beams) may be additionally or optionally enclosed by a thermally insulate material 720 (e.g., plastic, fiber-reinforced plastic (FRP), other composite material or a mineral-based with relatively lower thermal conductivity than the beams and columns). In some embodiments, the thermally insulate material 720 may be spaced from the sides of the steel member 702 to accommodate additional insulation 710 (e.g., semi rigid mineral wool). The additional insulation may be provided along the full length of the steel member 702, such as between the beam and adjoining floor-ceiling panels, regardless of whether or not the insulation 710 extends along the full length of the member 702. As further shown in FIG. 7A, insulative materials 440-*a* and 730-*a*, and respectively 440-*b* and 730-*b*, may also be provided at the exposed edges of the diaphragm. As previously described, these may include a water impermeable member (440-*a* and 440-*b*) which may in part seal the floor-ceiling panel and diaphragm edge against water intrusion (see e.g., description of water impermeable member 440 in FIG. 4) and may further provide thermal insulation by being formed of a material having relatively lower thermal conductivity. The water impermeable members 440-*a* and 440-*b* may enclose an additional insulation 730-*a* and 730-*b*, such as semi-rigid mineral wool insulation, sandwiched between the members 440-*a* and 440-*b* and the respective edge of the floor-ceiling panels.

Figure 8:
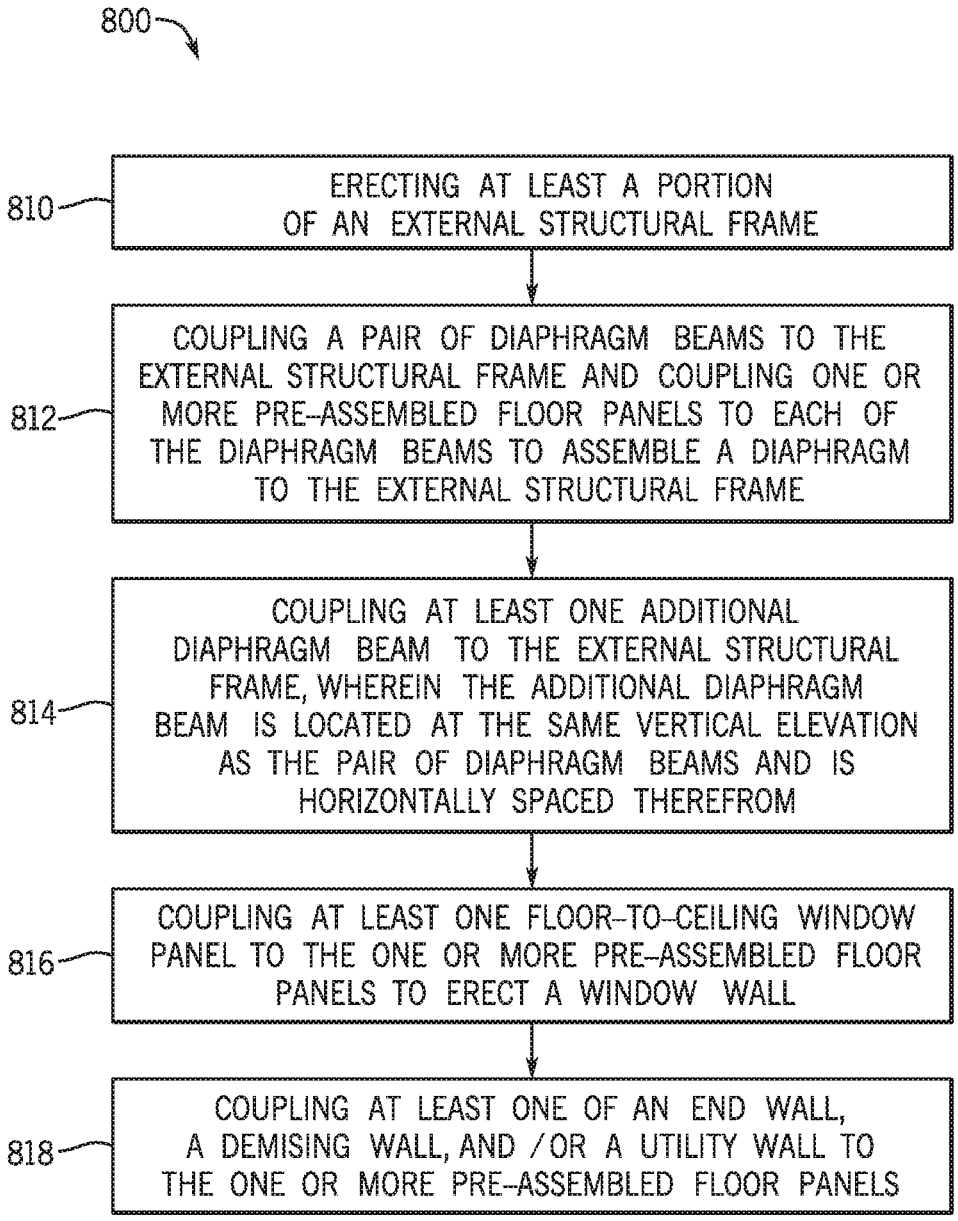
FIG. 8 is a flowchart of an example method for assembling at least a portion of a building.

FIG. 8 is flow diagram of an example method in accordance with the present disclosure. The method 800 may be used to assemble at least part of a building, such as building 101. An example method may include one or more operations, functions or actions as illustrated by one or more of the blocks 810-818. The various operations, functions or actions, collectively referred to as steps, shown in FIG. 10 are merely illustrative, and other variations, including eliminating one or more steps, combining one or more steps, and substituting one or more steps, or re-arranging the order of one or more steps are all contemplated.

An example method 800 may include erecting at least a portion of an external structural frame, as shown in block 810. The external structural frame (e.g., frame 210) may include a plurality of columns and a plurality of beams. Thus, the erecting at least a portion of the external structural frame may include the erecting of a plurality of vertical columns, and coupling a plurality of horizontal beams to the columns. The plurality of beams, also referred to as frame beams, may include at least a pair of first beams and a pair of second beams perpendicular to the pair of first beams.

The method may continue by assembling a diaphragm to the external structural frame, as shown in block 812. For example this may involve coupling each of a pair of diaphragm beams (e.g., beams 230-1 and 230-2) to the external structural frame (e.g., frame 210). The diaphragm beams may be coupled using coupling assemblies or joints (e.g., coupling assemblies 240-1, 240-2, 240-3, and 240-4). Each of the diaphragm beam may be joined at its opposite ends to a frame beam and/or directly to a column of the structural frame 210. The diaphragm beams may be joined to a respective load bearing member by mechanical fasteners (e.g., bolts), welding, or other suitable techniques. The assembling of the diaphragm may further involve coupling one or more pre-assembled floor-ceiling panels (e.g., floor-ceiling panels 222) to the diaphragm beams. Each floor-ceiling panel may be arranged with its opposite transverse edges resting onto a respective one of the pair of diaphragm beams. To that end, each floor-ceiling panel may be equipped with at least one mounting component (e.g., angles, angle clips, L-shaped brackets, or other suitable brackets) for connecting each floor-ceiling panel to the respective diaphragm beam. In some embodiments, the diaphragm beam may be a rectangular hollow structural section beam. The mounting components may be L-shaped brackets attached to a transverse edge of a floor-ceiling panel with one leg of the L-shaped bracket rigidly secured to the narrow (e.g., thickness) or another side of the floor-ceiling panel and the other leg of the L-shaped bracket projecting perpendicularly therefrom. The projecting legs at the opposite transverse edges of the floor-ceiling panel may be rested onto a top surface of the respective diagram beam and the floor-ceiling panel may then be secured to the diaphragm beams by mechanically joining (e.g., fastening or welding) the brackets to the diaphragm beams.

If multiple floor-ceiling panels are used to form a diaphragm, adjacent panels may be joined to the diaphragm beams and to one another. In some examples, the coupling of a plurality of floor-ceiling panels may involve coupling each floor-ceiling panel in the plurality in sequence (e.g., attach a first floor-ceiling panel to the diaphragm beams, attach a second adjacent floor-ceiling panel to the diaphragm beams and the previous panel, attach a third floor-ceiling panel to the diaphragm and the middle panel, etc.). Regardless of the number of diaphragm portions in a diaphragm according to the present disclosure, the diaphragm may be coupled to the external structural frame in a manner which provides a load path (i.e., for transmitting loads from the diaphragm to the frame) only via the coupling assemblies between the diaphragm beams and the frame. In the case of multiple floor-ceiling panels forming the diaphragm, adjacent floor-ceiling panels may be joined to one another and the outer most two floor-ceiling panels may have one respective unsupported longitudinal edge, corresponding to the free or unsupported edge of the diaphragm.

In some embodiments, e.g., as shown in blocks 816 and 818, the building envelope may be defined by installing walls (e.g., end walls, utility walls, and or window walls), and the interior of the building may be divided into units or rooms by installing interior walls (e.g., demising walls). As described herein, these walls may be provided by one or more pre-fabricated walls which are positioned, for example, over the diaphragm beams and connected thereto and/or to the floor-ceiling panels below and above the walls. As further described, some or all of these pre-assembled walls may be non-load bearing walls and may be coupled to the diaphragm in a manner which avoids the transference of structural loads to the walls.

In some embodiments, at least one of the plurality of panels may include a track for receiving a floor-to-ceiling window panel. After floor panels associated with an upper story have been similarly assembled, one or more floor-to-ceiling window panels may be inserted into the tracks (e.g., snapped into engagement with a lower and upper track) to seal the envelope of the building. To facilitate installation of the window panels, the tracks and/or window panels may be provided with a biasing member to allow the window panel to slip into engagement with the track. Since the tracks are pre-installed onto the respective floor-ceiling panels and pre-assembled walls, a time consuming step of glazing and caulking of windows as is typically done in conventional construction, may be avoided, thus reducing the overall building construction timeline and costs.

In some embodiments, the diaphragm may include multiple diaphragm portions (e.g., 220-1, 220-2, etc.) to provide a building with as large a foot print as may be desired. In such embodiments, additional portions of the diaphragm may be assembled, for example by coupling at least one additional diaphragm beam to the external structural frame and coupling one or more additional pre-assembled floor-ceiling panels to the additional diaphragm beam, e.g., as shown in block 814. The additional diaphragm beam would be located at the same vertical elevation or height as the first pair of diaphragm beams and would be spaced horizontally therefrom to accommodate the additional one or more floor-ceiling panels. This sequence may be continued to assemble as large a floor system as may be desired, for example a floor system including four diaphragm portions as shown in FIG. 2A.

In some embodiments, coupling a diaphragm beam to the external structural frame may include coupling at least one of the pair of lateral beams directly to a pair of columns of the external structural frame. In some embodiments, coupling a diaphragm beam to the external structural frame may include coupling at least one of the pair of lateral beams to load bearing members other than columns, e.g., to a pair of frame beams such as beams 214-2*a* and 214-2*b* of FIG. 2B. In some embodiments, each of the pair of diaphragm beams associated with a given diaphragm portion may be coupled to the external structural frame prior to coupling any of the floor-ceiling panels to the diaphragm beams. In other embodiments, the diaphragm may be assembled (e.g., by coupling the floor-ceiling panels to the diaphragm beams) and then the assembled diaphragm may be installed to the building (e.g., coupled to the external structural frame via the coupling assemblies 240).

The present disclosure is not to be limited in terms of the particular embodiments described in this application, which are intended as illustrations of various aspects. Many modifications and embodiments can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and embodiments are intended to fall within the scope of the appended claims. The present disclosure includes the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

While the foregoing detailed description has set forth various embodiments of the devices and/or processes via the use of block diagrams, flowcharts, and/or embodiments, such block diagrams, flowcharts, and/or embodiments contain one or more functions and/or operations, it will be understood by those within the art that each function and/or operation within such block diagrams, flowcharts, or embodiments can be implemented, individually and/or collectively, by a wide range of hardware, software, firmware, or virtually any combination thereof.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific embodiments of operably couplable include but are not limited to physically mateable and/or physically interacting components and/or wirelessly interactable and/or wirelessly interacting components and/or logically interacting and/or logically interactable components.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A building system, comprising:

an external structural frame including a plurality of vertical columns and a plurality of horizontal frame beams, wherein the plurality of vertical columns includes a first end column, a second end column, a third column, and a fourth column, and wherein the plurality of horizontal frame beams include a first frame beam that extends in a transverse direction and that joins the first end column to the second end column, a second frame beam that extends in a longitudinal direction perpendicular to the first frame beam and that joins the third column to the first end column, and a third frame beam that extends in the longitudinal direction parallel to the second frame beam and perpendicular to the first frame beam and that joins the fourth column to the second end column;

a diaphragm including a plurality of floor-ceiling panels, wherein each of the plurality of floor-ceiling panels extends in the longitudinal direction and in the transverse direction, and wherein the plurality of floor-ceiling panels are supported by a plurality of diaphragm beams arranged along the transverse direction;

a first track that extends along a first longitudinal edge of a first floor-ceiling panel of the plurality of floor-ceiling panels, wherein the first track is attached to a floor side of the first floor-ceiling panel and is configured to slidably receive a first floor-to-ceiling window panel that is inserted into the first track;

a second track that extends along the first longitudinal edge of the first floor-ceiling panel, wherein the second track is attached to a ceiling side of the first floor-ceiling panel and is configured to slidably receive a second floor-to-ceiling window panel that is inserted into the second track, wherein the first floor-ceiling panel is unsupported by the external structural frame along the first longitudinal edge;

a water impermeable member that encloses the first longitudinal edge of the first floor-ceiling panel, wherein the water impermeable member includes an upper flange that extends at least partially under the first track and a lower flange that extends at least partially under the second track; and coupling assemblies that join opposite ends of each of the diaphragm beams to the external structural frame such that structural loads are transmitted from the diaphragm to the external structural frame via the coupling assemblies between the diaphragm beams and the external structural frame, wherein the plurality of diaphragm beams includes a first diaphragm beam adjacent and parallel to the first frame beam, and wherein the coupling assemblies include a first coupling assembly to couple a first end of the first diaphragm beam to the second frame beam and a second coupling assembly to couple a second end of the first diaphragm beam to the third frame beam.

2. The building system of claim 1, wherein each of the plurality of floor-ceiling panels is a pre-assembled panel comprising:

opposite longitudinal edges that extend along the longitudinal direction;

opposite lateral edges that extend along the transverse direction; and a plurality of joists that extend in the longitudinal direction in a spaced arrangement between the opposite longitudinal edges.

3. The building system of claim 1, wherein the water impermeable member comprises:

a plastic or a composite c-channel that includes the upper flange and the lower flange, wherein the upper flange extends fully under the first track.

4. The building system of claim 3, wherein the upper flange includes a lip adjacent to an interior side of the first track, and wherein the lower flange includes a ledge adjacent to an exterior side of the second track.

5. The building system of claim 1, wherein the first floor-ceiling panel includes a second longitudinal edge configured to be coupled to a longitudinal edge of an adjacent floor-ceiling panel, and wherein the first floor-ceiling panel is unsupported by a frame beam of the external structural frame along the second longitudinal edge.

6. The building system of claim 1, wherein the plurality of floor-ceiling panels include at least one middle floor-ceiling panel having first and second longitudinal edges connected to adjacent floor-ceiling panels, and wherein the at least one middle floor-ceiling panel is unsupported by a frame beam of the external structural frame along both the first and second longitudinal edges of the middle floor-ceiling panel.

7. The building system of claim 1, wherein the diaphragm includes a diaphragm edge opposite the first longitudinal edge of the first floor-ceiling panel, and wherein a non-loadbearing wall is coupled to the diaphragm along the diaphragm edge.

8. The building system of claim 1, wherein each of the plurality of diaphragm beams is fire-rated.

9. The building system of claim 1, wherein each of the plurality of diaphragm beams is filled with a mineral-based material.

10. The building system of claim 9, wherein each of the plurality of diaphragm beams is a concrete-filled beam which includes at least one internal metal reinforcement member.

11. The building system of claim 1, wherein the plurality of diaphragm beams further includes a second diaphragm beam parallel to the first diaphragm beam and having a first end coupled to the third column and a second end coupled to the fourth column.

12. The building system of claim 11, wherein:

the plurality of diaphragm beams includes at least a third diaphragm beam in addition to the first diaphragm beam and the second diaphragm beam and that are spaced apart from each other and are each parallel to the first frame beam of the external structural frame, the first floor-ceiling panel is positioned between the first diaphragm beam and the second diaphragm beam, and opposite first and second edges of the first floor-ceiling panel along the transverse direction are respectively attached to the first diaphragm beam and the second diaphragm beam to enable load from the first floor-ceiling panel to be transferred to at least one of the first and second diaphragm beams and then to the external structural frame, and at least a second floor-ceiling panel of the plurality of floor-ceiling panels is positioned between the second diaphragm beam and the at least the third diaphragm beam, and opposite first and second edges of the at least the second floor-ceiling panel along the transverse direction are respectively attached to the second diaphragm beam and the at least the third diaphragm beam to enable load from the at least the second floor-ceiling panel to be transferred to at least one of the second and the at least the third diaphragm beams and then to the external structural frame.

13. A method of to assemble a building, the method comprising:

erecting at least a portion of an external structural frame including a plurality of vertical columns and a plurality of horizontal frame beams, wherein the plurality of vertical columns includes a first end column, a second end column, a third column, and a fourth column, and wherein the plurality of horizontal frame beams include a first frame beam that extends in a transverse direction and that joins the first end column to the second end column, a second frame beam that extends in a longitudinal direction perpendicular to the first frame beam and that joins the third column to the first end column, and a third frame beam that extends in the longitudinal direction parallel to the second frame beam and perpendicular to the first frame beam and that joins the fourth column to the second end column; and assembling a diaphragm to the external structural frame, wherein assembling the diaphragm includes:

joining, with coupling assemblies, opposite ends of each of a pair of diaphragm beams of a plurality of diaphragm beams to the external structural frame such that structural loads are transmitted from the diaphragm to the external structural frame via the coupling assemblies between the pair of diaphragm beams and the external structural frame, wherein the pair of diaphragm beams are arranged parallel to the first frame beam of the external structural frame, wherein the plurality of diaphragm beams includes a first diaphragm beam adjacent and parallel to the first frame beam, and wherein the coupling assemblies include a first coupling assembly to couple a first end of the first diaphragm beam to the second frame beam and a second coupling assembly to couple a second end of the first diaphragm beam to the third frame beam;

coupling a plurality of pre-assembled floor-ceiling panels to the pair of diaphragm beams, wherein each of the plurality of floor-ceiling panels extends in the longitudinal direction and in the transverse direction, such that each of the plurality of floor-ceiling panels is supported by the pair of diaphragm beams along the transverse direction of each respective floor-ceiling panel, and wherein each of the plurality of floor-ceiling panels is unsupported by any frame beam of the external structural frame along longitudinal edges of each respective floor-ceiling panel;

attaching a first track to a floor side of a first floor-ceiling panel of the plurality of pre-assembled floor-ceiling panels, wherein the first track extends along a first longitudinal edge of the first floor-ceiling panel and is configured to slidably receive a first floor-to-ceiling window panel that is inserted into the first track;

attaching a second track to a ceiling side of the first floor-ceiling panel, wherein the second track extends along the first longitudinal edge of the first floor-ceiling panel and is configured to slidably receive a second floor-to-ceiling window panel that is inserted into the second track; and enclosing the first longitudinal edge of the first floor-ceiling panel with a water impermeable member, wherein the water impermeable member includes an upper flange that extends at least partially under the first track and a lower flange that extends at least partially under the second track.

14. The method of claim 13, wherein joining opposite ends of each of the pair of diaphragm beams to the external structural frame includes respectively coupling first and second ends of a second diaphragm beam of the pair of diaphragm beams to the third and fourth columns of the external structural frame.

15. The method of claim 13, wherein coupling the plurality of pre-assembled floor-ceiling panels to the pair of diaphragm beams comprises coupling each floor-ceiling panel in the plurality of pre-assembled floor-ceiling panels in sequence.

16. The method of claim 15, wherein the sequence includes:

coupling the first floor-ceiling panel to the first diaphragm beam; and coupling a second floor-ceiling panel to a second diaphragm beam of the plurality of diaphragm beams and to the first floor-ceiling panel.

17. The method of claim 16, wherein the sequence further includes coupling a third floor-ceiling panel to the second diaphragm beam of the plurality of diaphragm beams and to the second floor-ceiling panel, and wherein the third floor-ceiling panel includes at least one plumbing component.

18. The method of claim 13, wherein the plurality of pre-assembled floor-ceiling panels includes a first plurality of pre-assembled floor-ceiling panels, and wherein assembling the diaphragm to the external structural frame further includes:

coupling an additional diaphragm beam to the external structural frame; and coupling a second plurality of pre-assembled floor-ceiling panels to one diaphragm beam of the pair of diaphragm beams and to the additional diaphragm beam.

19. The method of claim 18, wherein each diaphragm beam of the pair of diaphragm beams and the additional diaphragm beam are coupled to the external structural frame prior to coupling any of the floor-ceiling panels of the first and second pluralities of pre-assembled floor-ceiling panels to the pair of diaphragm beams.

20. A building system, comprising:

an external structural frame including a plurality of vertical columns and a plurality of horizontal frame beams, wherein the plurality of vertical columns includes a first end column, a second end column, a third column, and a fourth column, and wherein the plurality of horizontal frame beams include a first frame beam that extends in a transverse direction and that joins the first end column to the second end column, a second frame beam that extends in a longitudinal direction perpendicular to the first frame beam and that joins the third column to the first end column, and a third frame beam that extends in the longitudinal direction parallel to the second frame beam and perpendicular to the first frame beam and that joins the fourth column to the second end column;

a diaphragm including a plurality of floor-ceiling panels, wherein each of the plurality of floor-ceiling panels extends in the longitudinal direction and in the transverse direction, and wherein the plurality of floor-ceiling panels are supported by a plurality of diaphragm beams arranged along the transverse direction, and wherein each of the plurality of floor-ceiling panels is unsupported by the external structural frame along longitudinal edges of each respective floor-ceiling panel; and coupling assemblies that join opposite ends of each of the diaphragm beams to the external structural frame, wherein the plurality of diaphragm beams includes a first diaphragm beam adjacent and parallel to the first frame beam, and wherein the coupling assemblies include a first coupling assembly to couple a first end of the first diaphragm beam to the second frame beam and a second coupling assembly to couple a second end of the first diaphragm beam to the third frame beam.

21. The building system of claim 20, further comprising:

a first track that extends along a first longitudinal edge of a first floor-ceiling panel of the plurality of floor-ceiling panels, wherein the first track is attached to a floor side of the first floor-ceiling panel and is configured to slidably receive a first exterior panel that is inserted into the first track;

a second track that extends along the first longitudinal edge of the first floor-ceiling panel, wherein the second track is attached to a ceiling side of the first floor-ceiling panel and is configured to slidably receive a second exterior panel that is inserted into the second track; and a water impermeable member that encloses the first longitudinal edge of the first floor-ceiling panel, wherein the water impermeable member includes an upper flange that extends at least partially under the first track and a lower flange that extends at least partially under the second track, wherein the upper flange includes a lip adjacent to an interior side of the first track, and wherein the lower flange includes a ledge adjacent to an exterior side of the second track.

22. A building system, comprising:

an external structural frame including a plurality of vertical columns and a plurality of horizontal frame beams, wherein the plurality of vertical columns includes a first end column, a second end column, a third column, and a fourth column, and wherein the plurality of horizontal frame beams include a first frame beam that extends in a transverse direction and that joins the first end column to the second end column, a second frame beam that extends in a longitudinal direction perpendicular to the first frame beam and that joins the third column to the first end column, and a third frame beam that extends in the longitudinal direction parallel to the second frame beam and perpendicular to the first frame beam and that joins the fourth column to the second end column;

a diaphragm including a plurality of floor-ceiling panels, wherein each of the plurality of floor-ceiling panels extends in the longitudinal direction and in the transverse direction, wherein the plurality of floor-ceiling panels are supported by a plurality of diaphragm beams arranged along the transverse direction, wherein at least two floor-ceiling panels are connected to each other along their adjacent longitudinal edges and extend between consecutive first and second diaphragm beams such that first transverse edges of the at least two-floor ceiling panels are connected to the first diaphragm beam and second transverse of the at least two-floor ceiling panels are connected to the second diaphragm beam; and coupling assemblies that join opposite ends of each of the diaphragm beams to the external structural frame, wherein the plurality of diaphragm beams includes a first diaphragm beam adjacent and parallel to the first frame beam, and wherein the coupling assemblies include a first coupling assembly to couple a first end of the first diaphragm beam to the second frame beam and a second coupling assembly to couple a second end of the first diaphragm beam to the third frame beam.

23. The building system of claim 22, wherein each of the plurality of floor ceiling panels is unsupported by the external structural frame along longitudinal edges of each respective floor-ceiling panel.

* * * * *